US010987684B2

(12) United States Patent
Gullicks et al.

(10) Patent No.: US 10,987,684 B2
(45) Date of Patent: Apr. 27, 2021

(54) NOZZLE ASSEMBLIES, SYSTEMS AND RELATED METHODS

(71) Applicant: 3M INNOVATIVE PROPERTIES COMPANY, St. Paul, MN (US)

(72) Inventors: Scott D. Gullicks, Woodbury, MN (US); Stephen C. P. Joseph, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 14/908,233

(22) PCT Filed: Sep. 26, 2014

(86) PCT No.: PCT/US2014/057649

§ 371 (c)(1),
(2) Date: Jan. 28, 2016

(87) PCT Pub. No.: WO2015/053959

PCT Pub. Date: Apr. 16, 2015

(65) Prior Publication Data

US 2016/0175861 A1 Jun. 23, 2016

Related U.S. Application Data

(60) Provisional application No. 61/889,583, filed on Oct. 11, 2013.

(51) Int. Cl.
*B05B 7/00* (2006.01)
*B05B 7/24* (2006.01)
(Continued)

(52) U.S. Cl.
CPC ..... *B05B 7/2435* (2013.01); *B05B 1/304* (2013.01); *B05B 1/3013* (2013.01);
(Continued)

(58) Field of Classification Search
CPC ... B05B 7/2435; B05B 7/1209; B05B 7/2478; B05B 1/3013; B05B 7/0815;
(Continued)

(56) References Cited

U.S. PATENT DOCUMENTS 2,659,628 A 11/1953 Beach
4,899,938 A * 2/1990 Havrilla, Jr. ..... B05B 7/0815 239/294

(Continued)

FOREIGN PATENT DOCUMENTS

CH 390172 * 3/1965
CN 2282937 6/1998

(Continued)

OTHER PUBLICATIONS

Tanslation of CH390172.*

(Continued)

*Primary Examiner* — Qingzhang Zhou
(74) *Attorney, Agent, or Firm* — 3M IPC

(57) ABSTRACT

Nozzle assemblies (10) for spray guns are disclosed. The nozzle assemblies (10) generally include a fluid outlet (100) extending along a fluid axis (102), the fluid outlet (100) including a fluid aperture (104) and a fluid side wall (164) defining the fluid aperture (104), an atomizing aperture (108) adjacent the fluid side wall (164) and at least partially surrounding the fluid axis (102), an atomizing inlet (110) configured to receive a pressurized gas, and an adjustment member (150) located on the nozzle assembly (10) and movable to: (i) an atomizing position such that the atomizing inlet (110) is in communication with the atomizing aperture (108), and (ii) a non-atomizing position such that the atomizing inlet (110) is not in communication with the atomizing aperture (108). The foregoing nozzle assemblies (810) allow dispensing of fluid coating media in both spray and bead (Continued)

patterns with improved ease of cleaning, superior spray performance, and adaptability with existing spray gun platforms.

17 Claims, 13 Drawing Sheets

(51) Int. Cl.

| | |
|---|---|
| ***B05B 1/30*** | (2006.01) |
| ***B05B 7/08*** | (2006.01) |
| ***B05B 7/06*** | (2006.01) |
| ***B05B 7/12*** | (2006.01) |
| *B05B 15/50* | (2018.01) |

(52) U.S. Cl.
CPC ..... *B05B 1/3026* (2013.01); *B05B 7/066* (2013.01); *B05B 7/0815* (2013.01); *B05B 7/12* (2013.01); *B05B 7/1209* (2013.01); *B05B 7/2478* (2013.01); *B05B 15/50* (2018.02)

(58) Field of Classification Search
CPC ..... B05B 7/066; B05B 1/304; B05B 1/3026; B05B 7/12; B05B 15/02
USPC ..... 239/290, 291
See application file for complete search history.

(56) References Cited

U.S. PATENT DOCUMENTS

| | | | | |
|---|---|---|---|---|
| 4,907,741 | A * | 3/1990 | McIntyre | B05B 7/0475 239/124 |
| 4,948,053 | A * | 8/1990 | Hufgard | B05B 7/0081 239/296 |
| 5,217,168 | A * | 6/1993 | Svendsen | B05B 7/0815 239/297 |
| 5,803,367 | A * | 9/1998 | Heard | B05B 7/0815 239/296 |
| 6,068,203 | A * | 5/2000 | DeYoung | B05B 7/083 239/297 |
| 6,325,853 | B1 * | 12/2001 | Hogan | B05B 7/0861 118/300 |
| 2004/0262416 | A1 | 12/2004 | Micheli | |
| 2012/0160935 | A1 * | 6/2012 | Krayer | B05B 7/025 239/291 |
| 2014/0024651 | A1 | 1/2014 | Volcheck et al. | |
| 2014/0246519 | A1 * | 9/2014 | Johnson | B05B 7/066 239/422 |

FOREIGN PATENT DOCUMENTS

| | | |
|---|---|---|
| CN | 2344091 | 10/1999 |
| CN | 2395804 | 9/2000 |
| DE | 1 255 006 | 11/1967 |
| EP | 2468414 | 6/2012 |
| FR | 2 234 746 | 1/1975 |
| GB | 995656 | 6/1965 |
| SU | 608560 | 5/1978 |
| WO | WO 96/03220 | 2/1996 |
| WO | WO 2010/085801 | 7/2010 |
| WO | WO 2013/016474 | 1/2013 |

OTHER PUBLICATIONS

Lord Technical Tips, "Fusor® Sprayable Seam Sealer" © 2006 Lord Corporation OD TT3060 (Rev. 1 May 2006).
Lord User Instructions "Lord Fusor® 806 Seam Sealer and Texturizer (Sprayable)" © 2009 Lord Corporation OD UI3035 SAP1010113 (Rev. 1 May 2009).
Lord Fusor® Adhesives Catalog, "Lord Fusor® Automotive Repair Adhesives Body Shop Focused Adhesive Solutions" © 2013 Lord Corporation Printed in USA KR 8/13-5M PC3000 (Rev.3 Aug. 2013).
Lord, Fusor Spray "FUS-312 Seam Sealer Gun" webpage www.//eautotools.com/FUS-312-p/fus-312.htm; , retrieved Oct. 17, 2013.
Lord, Fusor Spray Gun Model PM3 "Operating Instructions for Spray Gun—Model PM3" (Oct. 23, 2013).

* cited by examiner

NOZZLE ASSEMBLIES, SYSTEMS AND RELATED METHODS

FIELD OF INVENTION

Provided are nozzle assemblies along with related systems and methods for controlled fluid delivery systems. More particularly, the provided nozzle assemblies are for use in spray guns, spray gun platforms, and spray head assemblies.

BACKGROUND

Handheld spray guns are commonly used in a variety of commercial and industrial applications. Such spray guns can be used with any of a number of coating media, including primers, paints, clearcoat, slurries, fine powders, and other fluid media capable of being atomized and directed through a spray nozzle onto a substrate. Notable applications for spray guns include painting and texturizing architectural surfaces such as walls and ceilings, as well as painting and body repair for marine and automotive exteriors.

The foregoing spray guns typically have a gun platform connected with a compressed air source and liquid passageway in communication with a spray nozzle. The air and liquid are generally directed into a flow channel, where the air atomizes the liquid into fine droplets that are propelled through the nozzle. One nuisance associated with such traditional spray guns is the accumulation of the coating media on the exterior and interior surfaces of the gun. Unless meticulously cleaned between operations, dried coating media can adversely impact spray performance and/or contaminate subsequent applications.

To overcome these difficulties, the flow channel can be incorporated into a discrete spray head assembly, such as described in PCT Publication WO 2010/085801 (Escoto, et al.). The spray head assembly, in turn, can be releasably attached to a spray gun platform that delivers compressed air to the spray head assembly. Optionally, the spray head assembly has an air supply manifold that delivers air to both a center air passage for atomizing the liquid and a separate fan control air passage for shaping the conical spray pattern after it leaves the nozzle. Advantageously, the spray head assembly can be easily detached for cleaning. If desired, the assembly can be molded from plastic and discarded after each application.

SUMMARY OF THE INVENTION

Certain specialized applications, such as vehicle seam sealer applications, benefit from dual-mode applicators capable of either spraying or extruding a bead of coating media onto a given substrate. Seam sealers can be used to provide a tough, yet flexible, material for the sealing of joints on primed or painted substrates such as steel or aluminum enclosures. Advantageously, these materials can provide a quick cure time and non-sag properties that assist in vertical applications.

While dual-mode applicators presently exist, they tend to suffer from poor spray performance and require a high degree of labor to clean out the flow channels. Moreover, these dual mode spray guns often have intricate internal cavities that are difficult to access and thoroughly clean. As a result, repeated use can lead to blockage or impair spraying performance. In some cases, the spray gun itself may be rendered inoperable if the residual material is not cleaned out properly and subsequently cures. Even where spray performance is not impacted, residual debris from prior spraying operations can spontaneously dislodge and become transmitted to the spraying surface, producing spray defects.

Using a detachable nozzle assembly could address some of the difficulties above, but no such nozzle assembly presently exists in the state of the art configured to dispense fluid coating media in both spray and bead patterns. While some spray guns allow adjustment of air flow to a nozzle assembly from the spray gun platform, these require a secondary valve and substantial time and labor for cleaning spray gun parts between applications. This secondary valve can wear out or otherwise degrade over time. Further, even meticulous cleaning may not prevent debris from becoming entrained in the discharged coating media, which adversely affects spray performance. Finally, such solutions would require wholesale replacement of the entire spray gun platform to provide dual-mode operation. The above drawbacks are obviated by the claimed invention.

In one aspect, a nozzle assembly is provided. The nozzle assembly comprises: a fluid outlet extending along a fluid axis and comprising a fluid aperture and a fluid side wall surrounding the fluid aperture; an atomizing aperture adjacent the fluid side wall and at least partially surrounding the fluid axis; an atomizing inlet configured to receive a pressurized gas; and an adjustment member located on the nozzle assembly and movable to: (i) an atomizing position such that the atomizing inlet is in communication with the atomizing aperture; and (ii) a non-atomizing position such that the atomizing inlet is not in communication with the atomizing aperture.

In some embodiments, the adjustment member is movably coupled to a base member, wherein at least one of the adjustment member and the base member comprises a pressure aperture permitting selective communication between the atomizing inlet and the atomizing aperture, and further wherein: (i) in the non-atomizing position, the pressure aperture is substantially occluded; and (ii) in the atomizing position, the pressure aperture is not substantially occluded.

In another aspect, a method of adjusting a dispensing mode for a spray gun is provided, the spray gun comprising a spray gun platform and a nozzle assembly connected to the spray gun platform, wherein the nozzle assembly includes a fluid aperture that receives and dispenses a coating media and fluid side wall surrounding the fluid aperture. The method comprises: providing an atomizing aperture adjacent the fluid side wall, wherein the atomizing aperture at least partially surrounds the fluid axis; and moving an adjustment member located on the nozzle assembly between: (i) an atomizing position where the atomizing aperture communicates with a pressurized gas whereby the coating media sprays from the fluid aperture; and (ii) a non-atomizing position where the atomizing aperture does not communicate with a pressurized gas whereby the coating media extrudes from the fluid aperture.

In still another aspect, a spray gun system is provided, comprising: a spray gun platform; and a set of nozzle assemblies adapted for modular connection to the spray gun platform, wherein at least one but fewer than all nozzle assemblies in the set comprise: a fluid outlet extending along a fluid axis and comprising a fluid aperture and fluid side wall surrounding the fluid aperture; an atomizing aperture adjacent the fluid side wall and at least partially surrounding the fluid axis; an atomizing inlet configured to receive a pressurized gas; and an adjustment member located on the nozzle assembly and movable to: (i) an atomizing position such that the atomizing inlet is in communication with the atomizing aperture; and (ii) a non-atomizing position such that the atomizing inlet is not in communication with the atomizing aperture.

The above summary is not intended to describe each embodiment or every implementation of the reservoirs and associated vent assemblies described herein. Rather, a more complete understanding of the invention will become apparent and appreciated by reference to the following Description of the Illustrative Embodiments and Claims in view of the accompanying figures of the drawing.

DETAILED DESCRIPTION OF THE DRAWINGS

Throughout the specification, reference is made to the appended drawings, where like reference numerals designate like elements.

FIGS. 18A, 18B, 18C, and 18D provide a comparison of fragmentary side cross-sectional views of adjacent nozzle assembly components according to various embodiments.

Figure 18:
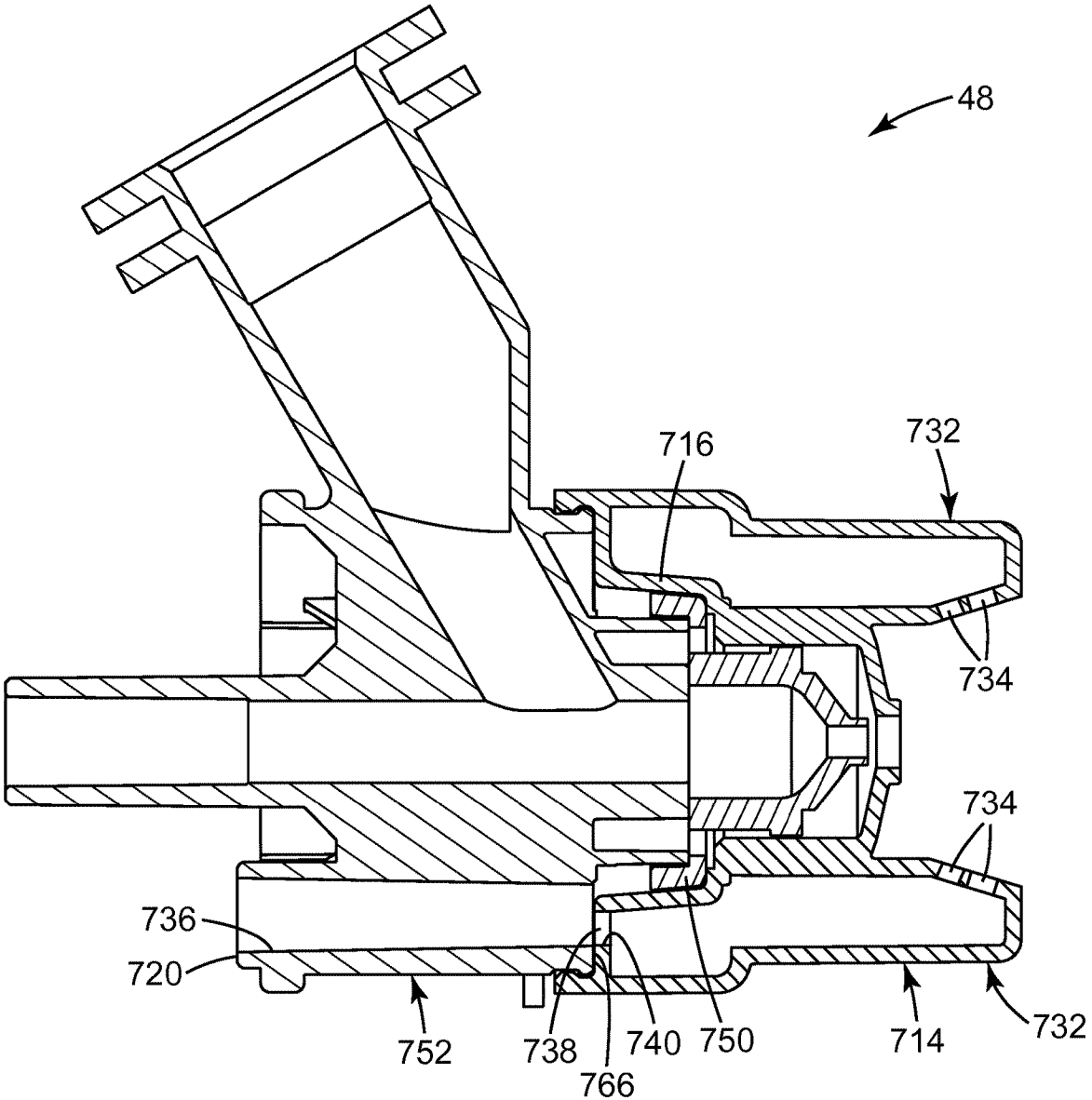
FIG. 18 is a side cross-sectional view of a nozzle assembly according to yet another exemplary embodiment.
Figure 18A:
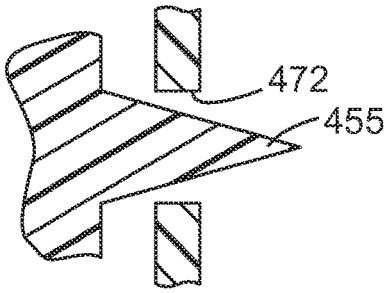
Figure 18A:
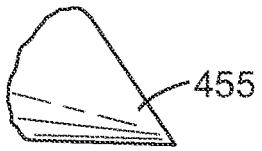
Figure 18B:
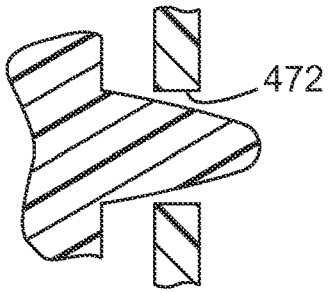
Figure 18B:
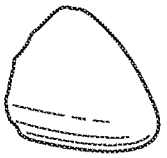
Figure 18C:
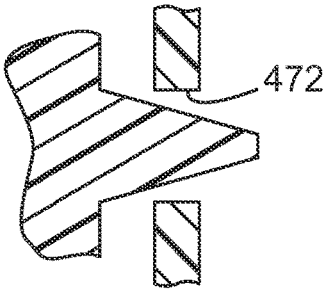
Figure 18C:
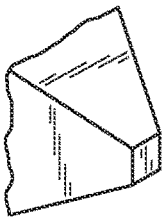
Figure 18D:
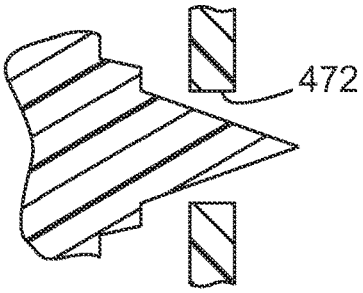
Figure 18D:
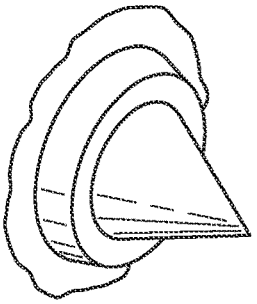

FIGS. 18A', 18B', 18C', and 18D' provide a comparison of fragmentary perspective views of nozzle assembly components shown in FIGS. 18A, 18B, 18C, and 18D, respectively.

DETAILED DESCRIPTION OF THE ILLUSTRATIVE EMBODIMENTS

The words "preferred" and "preferably" refer to embodiments described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Figure 1:
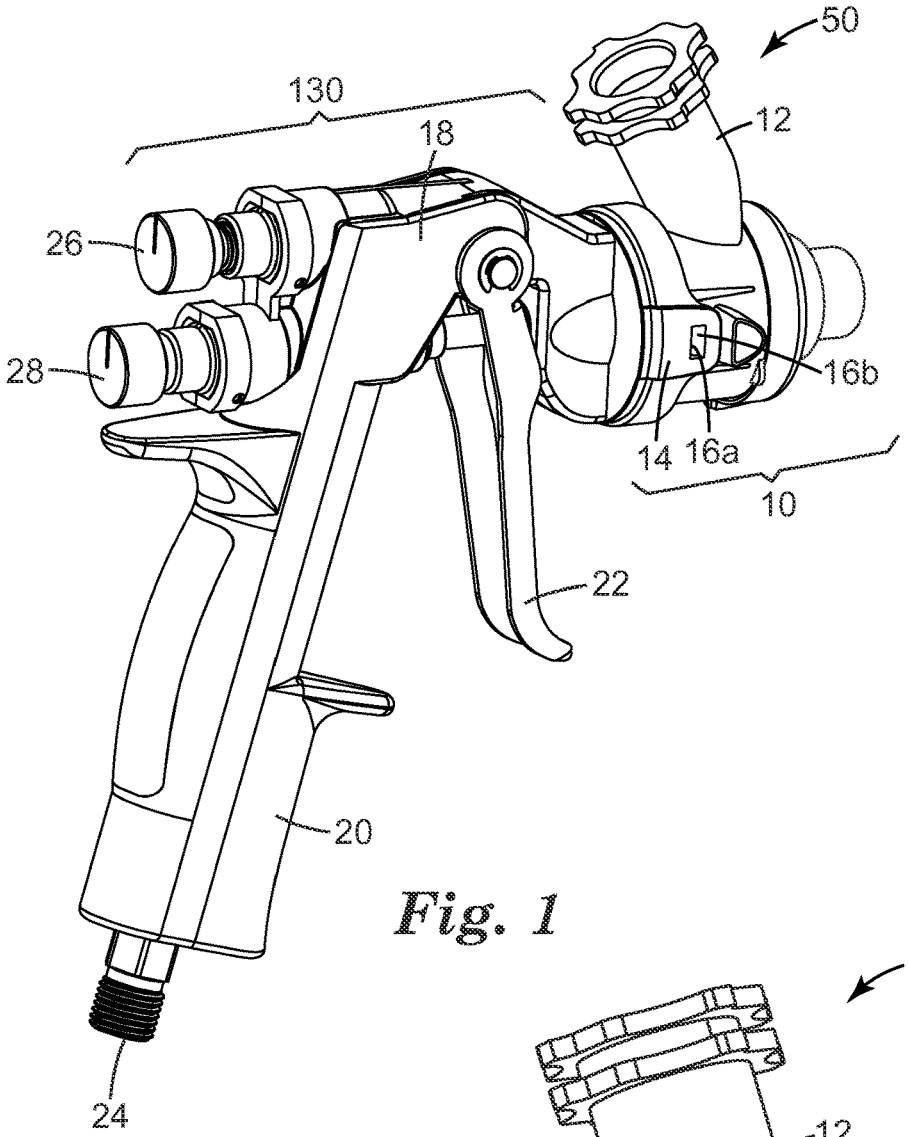
FIG. 1 is a perspective view of a spray gun according to one exemplary embodiment, showing its right side, rear, and top surfaces.

A spray gun according to one exemplary embodiment is shown in FIG. 1 and represented by the numeral 50. As shown, the spray gun 50 includes a spray gun platform 130 and nozzle assembly 10. Preferably, the nozzle assembly 10 is releasably connected to the spray gun platform 130, allowing the former to be cleaned, or disposed of, separately from the latter following a dispensing application. If so desired, some or all of these components can also be permanently connected. Extending outwardly from the nozzle assembly 10 in generally upward and rearward directions is a fluid inlet 12, adapted for releasable connection to a fluid container or other fluid source (not shown here).

Advantageously, the fluid inlet 12 is formed outboard from the gun interface portion 120 such that a coating fluid delivered to the nozzle assembly 10 does not pass through the spray gun platform 130. In some embodiments, the nozzle assembly 10 is disposable and conveniently discarded after use. Since the coating fluid does not pass through the spray gun platform 130, cleaning of the spray gun platform 130 is obviated, saving substantial operator time and labor. Further, the spray gun 50 can be converted over to dispense a different fluid, if desired, by attaching a different nozzle assembly 10 connected to the same or a different fluid container.

Alternatively, the fluid inlet 12 is formed within the gun interface portion 120 such that coating fluid delivered to the nozzle assembly 10 passes through the spray gun platform 130.

The connection between the nozzle assembly 10 and the spray gun platform 130 can be made using any attachment mechanism known in the art. In the embodiment shown, the spray gun platform 130 includes mating connection features that mechanically interlock to a gun interface portion (shown in FIG. 5) of the nozzle assembly 10, thus providing a releasable connection capable of forming hermetic seal between these components.

In some embodiments, the spray gun platform 130 and nozzle assembly 10 are interconnected using an interference fit. To this end, the former includes a pair of flexible connection tabs 14 having respective rectangular openings 16*a*. The rectangular openings 16*a* snap over matching rectangular projections 16*b* located on the nozzle assembly 10 and prevent the nozzle assembly 10 from becoming inadvertently detached. Alternatively or in combination, other mechanisms can be used, such as bayonet-type fixtures, clamps, collars, magnets, and threaded connections.

Referring again to FIG. 1, the spray gun platform 130 includes a frame 18, and a pistol-grip handle 20 and trigger 22 connected to the frame 18. Extending outwardly from the bottom of the handle 20 is a threaded air inlet port 24 for connection to a suitable source of pressurized gas, the gas typically being air. As used herein, "pressurized gas" refers to gas under greater than atmospheric pressure. Optionally and as shown, the trigger 22 is pivotally connected to the frame 18 and biased in its forward-most position. While grasping the handle 20, an operator depresses the trigger 22 to dispense the coating fluid from the spray gun 50.

Additional manual controls are built into the rear-facing surface of the frame 18, including a fan control regulator 26 and a fluid control regulator 28. In this implementation, the fan control regulator 26 is a rotatable knob and allows an operator to control air flow to a pair of optional air horns used to adjust the spray pattern geometry (air horns not present in the nozzle assembly 10). The fluid control knob (center air regulator 28) can be adjusted so as to limit the longitudinal travel distance of a fluid needle in a needle valve (not visible here). As will be shown later, the travel of the fluid needle can affect both fluid flow and center air flow (atomization air).

FIGS. 2-10 show, according to various views, operative aspects of the nozzle assembly 10 and its components in more detail.

Figure 2:
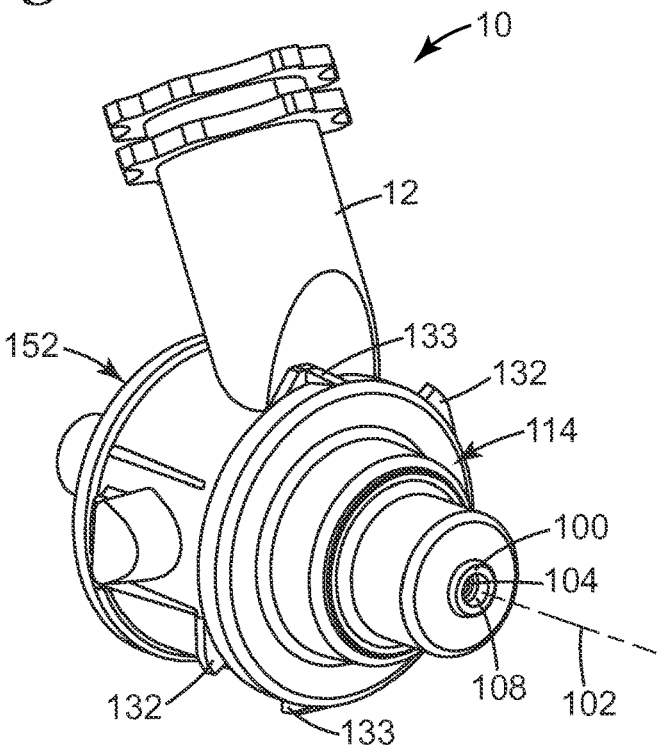
FIG. 2 is a perspective view of a nozzle assembly of the spray gun in FIG. 1, showing its right side, front, and top surfaces.

As illustrated in FIG. 2, the nozzle assembly 10 includes a generally cylindrical base member 152 and a pressure cap 114 rotatably engaged to the base member 152. In this exemplary embodiment, the base member 152 remains fixed relative to the spray gun platform 130, while an operator can rotate the pressure cap 114 relative to the base member 152 in a limited fashion about fluid axis 102. In the embodiment shown, rotation of the pressure cap 114 is constrained by one or more rotational stops 132 on the base member 152. The stops 132 abut against corresponding prongs 133 located on the pressure cap 114, constraining movement of the pressure cap 114 to about an angular range from an atomizing ("spray") position to a non-atomizing ("bead") position, with partial/reduced atomizing positions between these endpoints.

As described earlier, the coating fluid is fed into the base member 152 of the nozzle assembly 10 through the fluid inlet 12. In some embodiments, the coating fluid is fed with the assistance of gravity. Alternative configurations, such as pressurized feed or pressure-assisted feed, are also possible. For example, while FIGS. 2-4, the fluid inlet 12 extends outwardly from the top surface of the base member 152 at a slight rearward angle, the fluid inlet 12 could alternatively be located below the base member 152. In this alternative embodiment, the fluid container could be sufficiently pressurized from the outside to urge the coating fluid through the fluid inlet 12 against the force of gravity.

Located at the working end of the pressure cap 114 of the nozzle assembly 10 is a fluid outlet 100. The fluid outlet 100 extends along the fluid axis 102 and includes a fluid side wall 164 defining a fluid aperture 104 from which a coating fluid is dispensed. Optionally and as shown, the fluid outlet 100 has a generally circular cross-section and is symmetrically disposed about the fluid axis 102. Although the inner and outer diameters of the fluid side wall 164 are not critical, these parameters may be adjusted to control the degree of precision in spraying or extruding coating fluid from the nozzle assembly 10.

Figure 3:
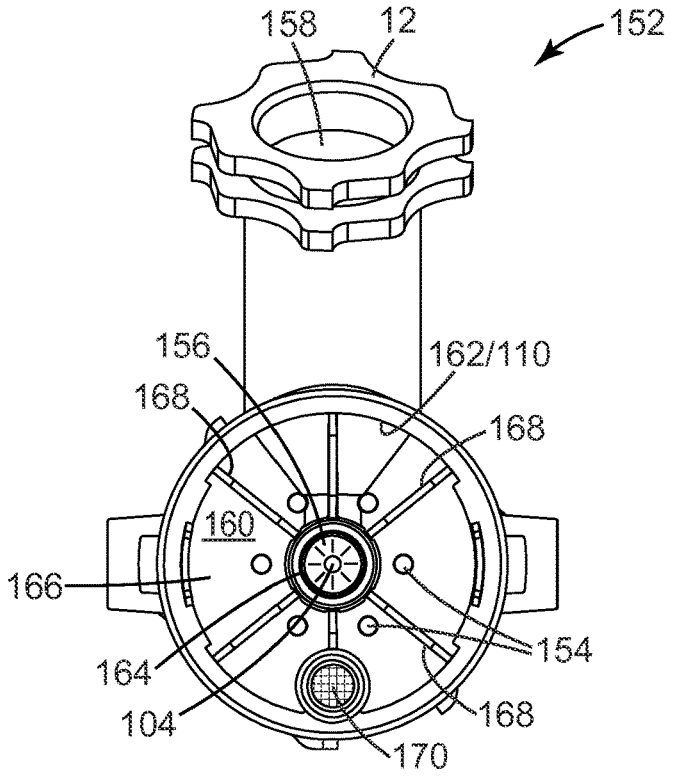
FIG. 3 is a rear elevational view of the nozzle assembly of FIG. 2.
Figure 4:
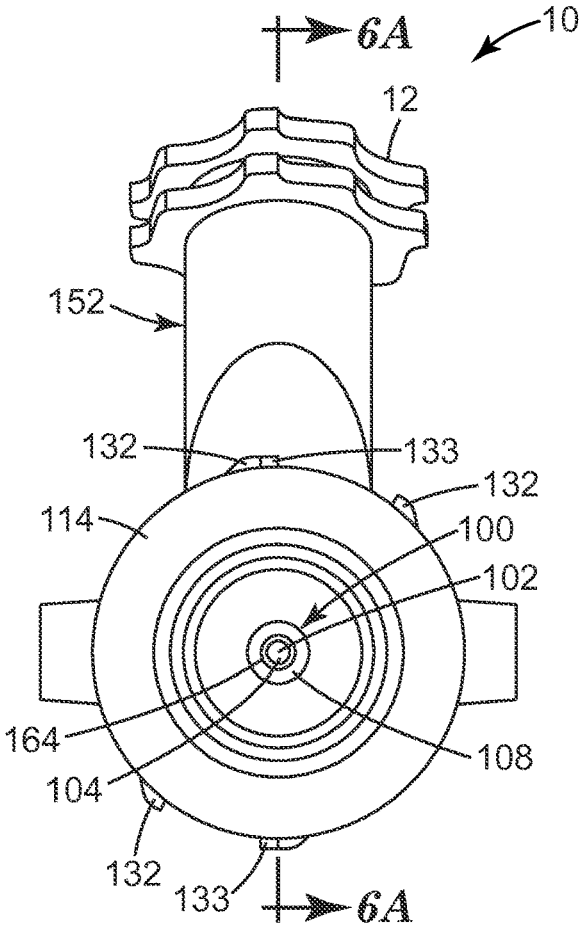
FIG. 4 is a front elevational view of the nozzle assembly of FIGS. 2-3.
Figure 5:
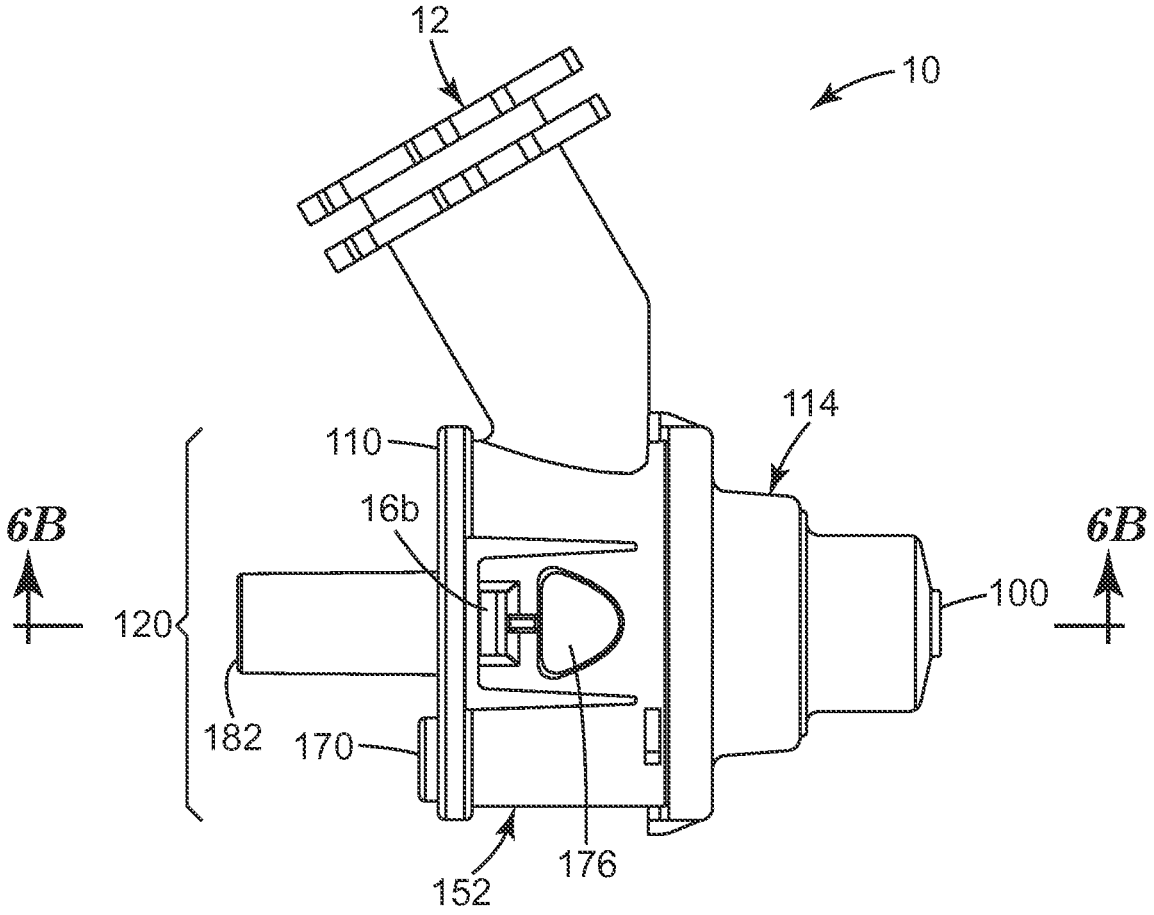
FIG. 5 is a side elevational view of the nozzle assembly of FIGS. 2-4, showing its right side.

Further details of the base member 152 and pressure cap 114 are provided with reference to FIGS. 3-4, which show rear- and front-facing views of the nozzle assembly 10, respectively. Looking to the rear-facing surfaces of the nozzle assembly 10 in FIG. 3, the base member 152 has an outer side wall 162 that provides an atomizing inlet 110 configured to receive a pressurized gas from the spray gun platform 130. Preferably, the atomizing inlet 110 has a configuration that provides an air-tight seal with complementary mating surfaces on the spray gun platform 130. As shown in FIG. 5, the atomizing inlet 110 is one part of an overall gun interface portion 120 of the nozzle assembly 10 that also includes, for example, fluid needle inlet 182 and fan control stopper 170.

As shown in FIG. 3 (along with FIGS. 6A and 6B), the base member 152 includes internal structures defining passageways for conveying both the coating fluid and air used to atomize the coating fluid. During a dispensing operation, the coating fluid enters the fluid inlet 12, flows through fluid inlet passage 158, and merges with the fluid passageway 156, where it eventually exits from the fluid aperture 104 at the distal end of the nozzle assembly 10. Located around the fluid passageway 156 is an air chamber 160 defined by the atomizing inlet 110, outer side wall 162 of the base member 152, inner fluid side wall 164, and front wall 166 of the base member 152 (see FIG. 6B). The air chamber 160 and fluid passageway 156 are normally isolated from each other by the inner fluid side wall 164 when the spray gun 50 is not in operation.

When the nozzle assembly 10 is secured to the spray gun platform 130, the air chamber 160 can be connected to a source of pressurized air. In some embodiments, the pressurized air flows out of a port in the spray gun platform 130. When the spray gun 50 is operating in "spray" mode, the air entering the air chamber 160 traverses the base member 152 and exits through one or more (here, six) rear pressure apertures 154 perforating the front wall 166 of the base member 152. Optionally and as shown, the outer side wall 162 is connected to the inner fluid side wall 164 by a plurality of radially extending webs 168. The webs 168 assist in providing increased structural integrity of the base member 152 but are not so large as to fully divide the air chamber 160 into independent cavities.

As will be further described later, when the spray gun 50 is operated in its "bead" mode, air entering the air chamber 160 will be blocked from passing through the rear pressure apertures 154 by adjacent adjustment member 150 (visible in FIGS. 6-10). Therefore, the pressure apertures 154 and adjustment member 150 cooperate to permit selective communication between the atomizing inlet 110 and an atomizing aperture 108.

Notably, the embodiment of the nozzle assembly 10 shown in FIGS. 1-10 does not employ diametrically opposed air horns. As described in PCT Application No. WO 2010/085801 (Escoto, et al.), these air horns shape the stream of fluid after it is discharged from the fluid outlet 100. Accordingly, and to allow the nozzle assembly 10 to be retrofitted to existing spray gun platforms 130, the base member 152 includes the fan control stopper 170. The fan control stopper 170 prevents air from the fan control regulator 26 from porting into the air chamber 160. The fan control stopper 170 effectively disables use of the fan control air and allows the pressure within the air chamber 160 to be regulated exclusively using the fluid control regulator 28.

In some embodiments, the fan control stopper 170 is not needed because the fan control air and center air are allowed to mix within the air chamber 160 and become expelled together through the atomizing aperture 108. As a further alternative, the fan control stopper 170 could be obviated by routing the fan control air to a dead space within the nozzle assembly 10 that is not in communication with the atomizing aperture 108.

FIG. 4 shows the nozzle assembly 10 as viewed from the front. As shown, the distal end of the nozzle assembly 10 includes the circular fluid aperture 104 that communicates with the fluid passageway 156. Adjacent the inner fluid side wall 164 and at least partially surrounding the fluid axis 102 is the atomizing aperture 108 communicating with the rear pressure apertures 154 when the coating fluid is being sprayed from the fluid outlet 100. In the embodiment shown, the apertures 104, 108 are concentrically located about the fluid axis 102 and mutually separated by the inner fluid side wall 164.

FIG. 5 reveals, in more detail, structures on the sides of the nozzle assembly 10 used to releasably attach the base member 152 of the nozzle assembly 10 to the spray gun platform 130. Such structures include, for example, posts 176 that protrude outwardly from the left and right sides of the base member 152. The posts 176 are operatively coupled to the rectangular projections **16*b* and enable an operator, using finger pressure, to press the rectangular projections 16*b* inwardly toward each other to engage and disengage the rectangular projections 16*b* from mating rectangular openings 16*a* on the spray gun platform 130**.

Figure 6A:
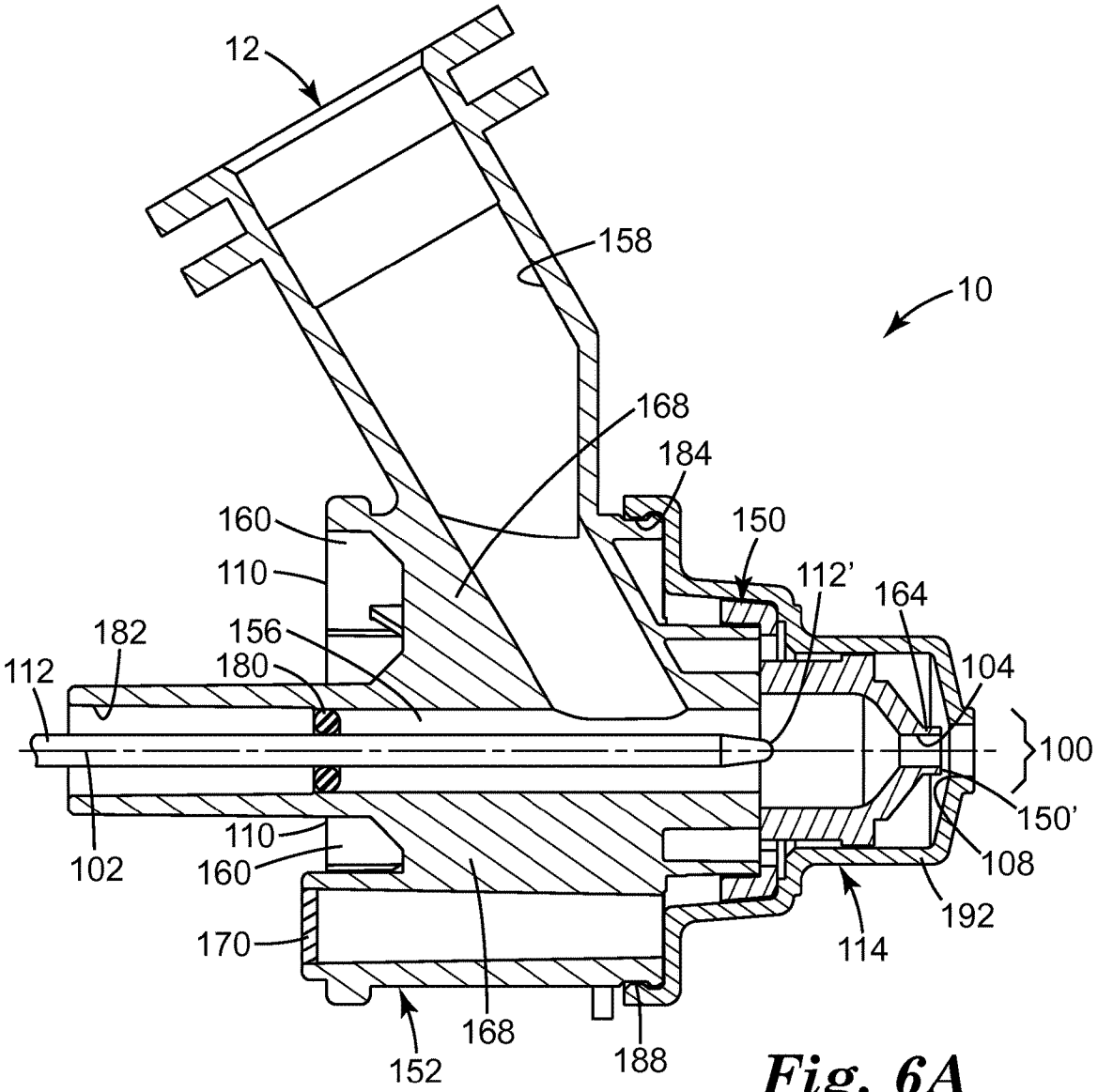
FIGS. 6A and 6B are respective side and top cross-sectional views of the nozzle assembly of FIGS. 2-5, coupled to a spray gun platform.
Figure 6B:
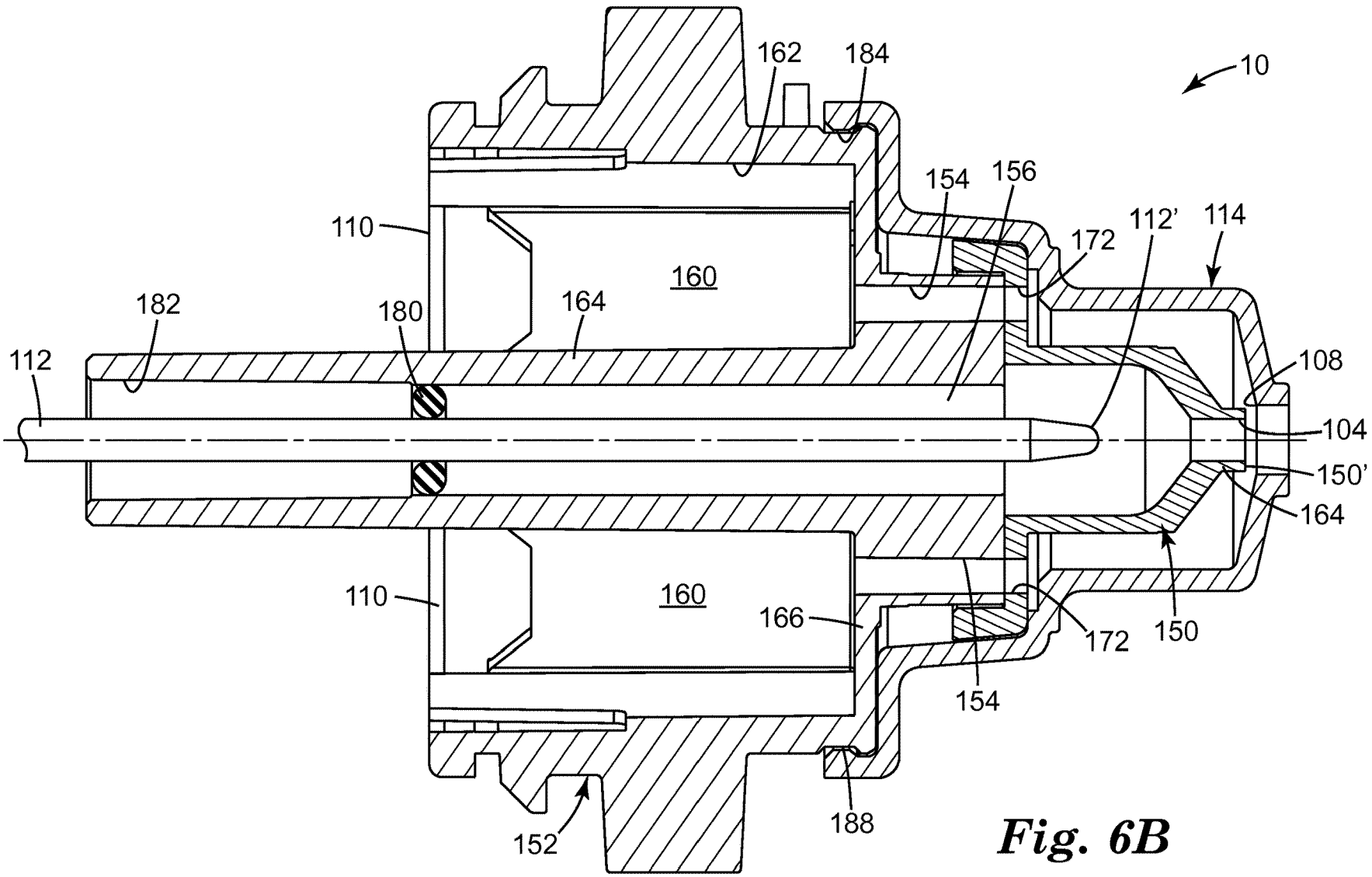

FIGS. 6A and 6B are cross-sectional views showing the base member 152, adjustment member 150, and pressure cap 114 as assembled. To hold these components together, the pressure cap 114 has an annular ridge 184 located near its rear terminal edge in an interference fit with a complementary receiving groove 188 on the base member 152. The receiving groove 188 allows relative rotation between these parts about the fluid axis 102 while preventing spontaneous disengagement. The adjustment member 150 is held captive between the base member 152 and the pressure cap 114, but can rotate along with the pressure cap 114.

As illustrated in these figures, interior surfaces of the nozzle assembly 10 collectively define air and fluid passageways used to dispense the coating fluid from the spray gun 50. For example, tracing the interior path of the coating fluid in FIG. 6A, the fluid enters the nozzle assembly 10 through the fluid inlet 12 and travels through the fluid inlet passage 158 toward the fluid axis 102. The fluid inlet passage 158 then merges with a fluid passageway 156 that extends along the fluid axis 102 from the fluid needle inlet 182 to the fluid aperture 104.

When the nozzle assembly 10 is coupled to the spray gun platform 130, an optional fluid needle 112 extends into the fluid passageway 156. The fluid needle 112, which is controlled by the spray gun platform 130, advances and retracts longitudinally within the fluid passageway 156 as the operator depresses and releases the trigger 22 of the spray gun 50, respectively. Towards the rear of the fluid passageway 156, o-ring 180 forms a fluid-tight seal around the fluid needle 112 and prevents the coating fluid from flowing backward into the spray gun platform 130. In some embodiments, the viscosity of the coating fluid may be such that, even in the absence of the fluid needle 112, the coating fluid would not necessarily flow out of the fluid needle inlet 182 in an uncontrolled manner.

Optionally but not shown, the fluid needle 112 could be built into the nozzle assembly 10 while having a configuration substantially similar to that shown FIGS. 6A and 6B. In this variation, the fluid needle 112 could be mechanically controlled by the spray gun platform 130 yet adapted for easy disengagement from the spray gun platform 130 along with the nozzle assembly 10 after use. Advantageously, such a fluid needle could be made from plastic and discarded after use, thereby avoiding any further cleaning steps associated with the spray gun platform 130.

In the position shown in FIGS. 6A and 6B, the trigger 22 is fully depressed, causing the fluid needle 112 to be fully retracted. With the fluid needle 112 in this open position, the tapered distal end 112' of the fluid needle 112 does not fully occlude the fluid aperture 104, thus allowing coating fluid to flow freely though the fluid passageway 156 and fluid aperture 104. When the trigger 22 is released, the fluid needle 112 returns to its neutral position (not shown), in which the distal end 112' of the fluid needle 112 fully occludes the fluid aperture 104. With the fluid needle 112 in this position, the coating fluid is sealed in the fluid passageway 156 and prevented from exiting the fluid aperture 104. Optionally, the distal end 112' of the fluid needle 112 can have a shape that generally conforms to that of the fluid aperture 104 to enable an even tighter seal.

FIG. 6B illustrates the path of air flow when the nozzle assembly 10 is in "spray" mode. As shown, pressurized air flows into the air chamber 160 from the atomizing inlet 110, traverses the air chamber 160 and the rear and front pressure apertures 154, 172, and is finally expelled through the atomizing aperture 108. In the embodiment shown, the atomizing aperture 108 is defined by the annular gap between the distal end 150' of the adjustment member 150 and a side wall 192 of the pressure cap 114 adjacent the fluid outlet 100. Additional details concerning the routing of pressurized air during operation of the spray gun 50 will be described with respect to FIGS. 7-10.

As shown in FIGS. 6A-6B, the distal end 150' defining the fluid aperture 104 is recessed relative to the distal end of the pressure cap 114 defining the outer circumference of the atomizing aperture 108. This recessed arrangement of the fluid aperture 104 was found to yield improved spray performance where the coating fluid is viscous and extrudable from the fluid aperture 104. Alternatively, the fluid aperture 104 and atomizing aperture 108 could be aligned flush with each other such that the coating fluid and atomizing air do not contact each other until wholly discharged from the nozzle assembly 10. These elements could also be disposed in different relative positions than those shown or described.

Figure 7:
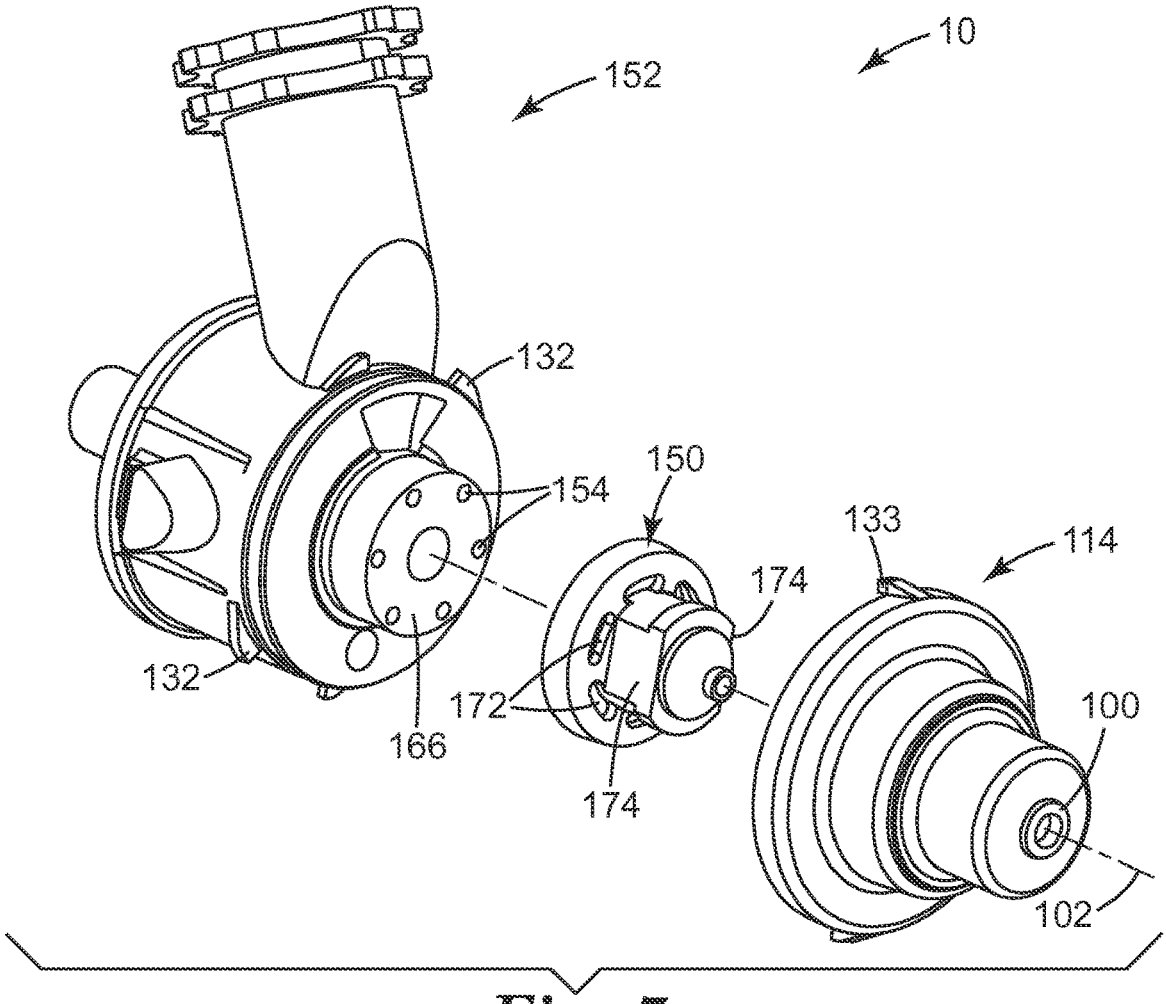
FIG. 7 is an exploded perspective view of the nozzle assembly of FIGS. 2-6B, showing its right side, front, and top surfaces.

FIG. 7 shows an exploded view of the nozzle assembly 10, revealing the base member 152, adjustment member 150, and pressure cap 114. As depicted in this embodiment, the adjustment member 150 is a generally annular, ring-shaped component that is optionally assembled to the pressure cap 114. As shown here, the adjustment member 150 has a pair of parallel surfaces 174 that flatly engage reciprocal surfaces on the inner surface of the pressure cap 114 to prevent the adjustment member 150 and pressure cap 114 from rotating relative to each other when assembled.

The rear pressure apertures 154 are visible on the opposing surface of the front wall 166. In the embodiment shown, the one or more pressure apertures 154 are optionally evenly distributed along a circular path about the fluid axis 102. In this particular embodiment, each of the rear pressure apertures 154 is circular as viewed from a direction parallel the fluid axis 102. The adjustment member 150 resides immediately in front of the base member 152 and includes corresponding front pressure apertures 172 passing through the adjustment member 150 parallel to the fluid axis 102. In the embodiment shown, unlike the circular rear pressure apertures 154, the front pressure apertures 172 are represented by slots elongated along a circular path concentric with the fluid axis 102 as viewed from a direction parallel the fluid axis 102.

When the adjustment member 150 resides in an intermediate position, the atomizing inlet 110 is in communication with the atomizing aperture 108, but with increased air flow restriction between the atomizing inlet 110 and the atomizing aperture 108 relative to when the adjustment member 150 is in its atomizing position.

Advantageously, either the rear or front pressure apertures 154, 172 can be shaped to cooperate to achieve the desired air flow characteristics through the nozzle assembly 10. For example, either or both the pressure apertures 154, 172 could be tapered such that the radial width of each aperture varies along its length. Such aperture geometries could provide for a gradual transition between the atomizing and non-atomizing modes. In some embodiments, the degree of flow restriction as the adjustment member 150 is moved from the atomizing position toward the non-atomizing position. In some cases, such increase can be configured to increase approximately linearly. As an added advantage, the adjustment member 150 can essentially function much like the fluid control regulator 28 in that it adjusts the magnitude of the atomizing air flow provided at the atomizing aperture 108. With air flow controlled exclusively from the pressure cap 114, the fluid control regulator 28 can be entirely omitted from the spray gun platform 130.

Figure 8:
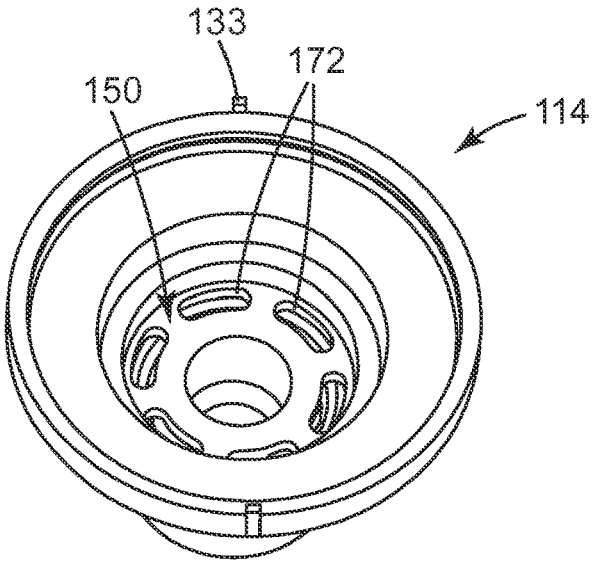
FIG. 8 is a perspective view of two components of the nozzle assembly of FIGS. 2-7 assembled to each other, showing rear and bottom surfaces.

FIG. 8 shows the adjustment member 150 and the pressure cap 114 in assembled form, whereby an operator can move the adjustment member 150 relative to the base member 152 simply by rotating the pressure cap 114. It is contemplated that the adjustment member 150 could be incorporated as an integral component with the pressure cap 114 to facilitate assembly. As another option, the adjustment member 150 could be movable relative to the pressure cap 114. For example, the pressure cap 114 could be held stationary with respect to the spray gun platform 130, while a window, knob, lever, or other mechanism enables an operator to independently rotate the adjustment member 150. Optional wings or other outwardly extending features (bosses, texture, knurling, etc.) could be disposed on the exterior surface of the pressure cap 114 to enable easier rotation or indexing of the adjustment member 150.

Figure 9:
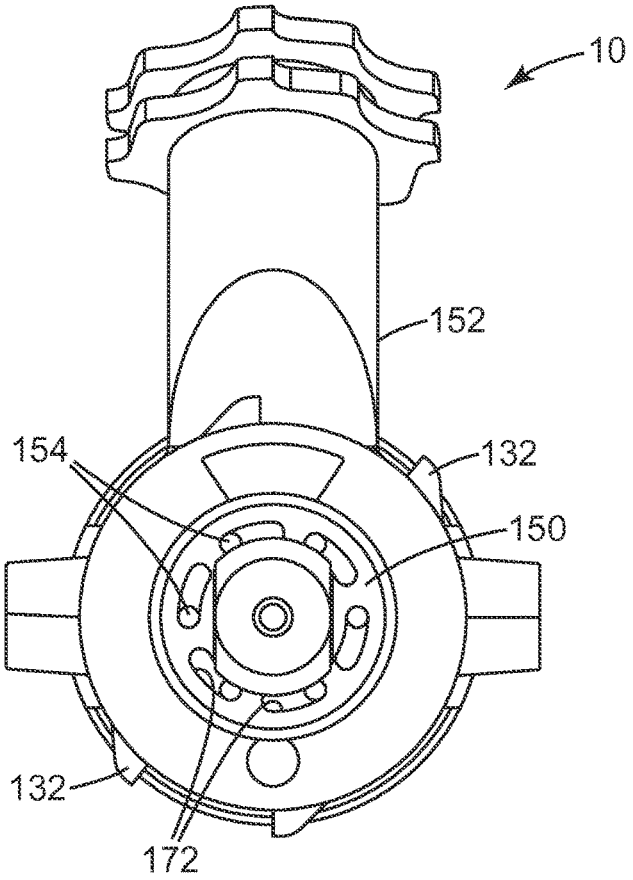
FIG. 9 is a front cross-sectional view of the nozzle assembly of FIGS. 2-8 in a first configuration.
Figure 10:
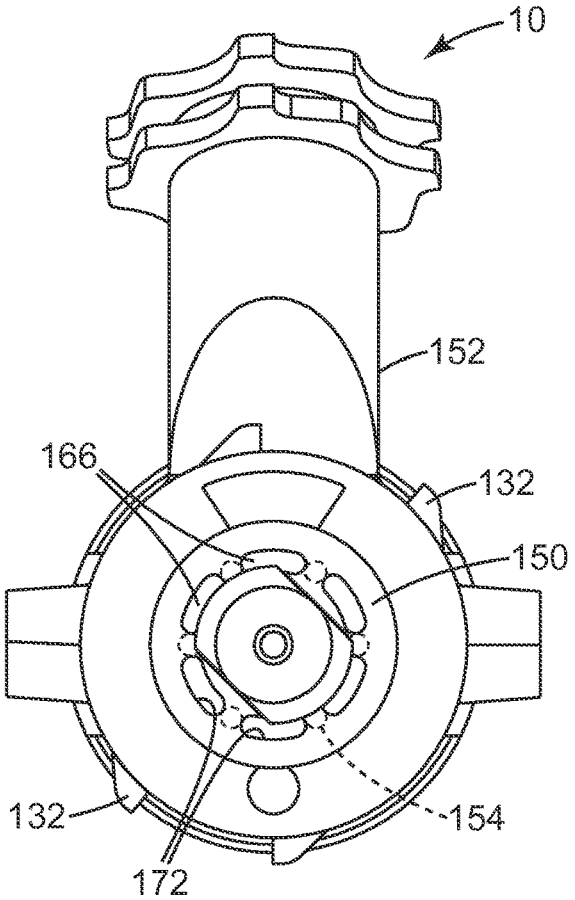
FIG. 10 is a front cross-sectional view of the nozzle assembly of FIGS. 2-9 in a second configuration.

FIGS. 9 and 10 illustrate the ability of a user to toggle between dispensing modes based on the relative positions of the base member 152 and the adjustment member 150. For illustrative purposes only, the pressure cap 114 has been removed from these views for clarity.

FIG. 9 shows the nozzle assembly 10 operating in its atomizing, or "spray," mode. In the spray mode, the adjustment member 150 and base member 152 are rotated into at least partial alignment such that the rear pressure apertures 154 and front pressure apertures 172 overlap with each other. When the pressure apertures 154, 172 are not substantially occluded, the atomizing inlet 110 is in communication with the atomizing aperture 108 and the coating fluid sprays from the fluid outlet 100.

Air injected under pressure through the nozzle assembly 10 accelerates as it enters regions of decreasing cross-section and generates a pressure drop at the atomizing aperture 108 due to Bernoulli's principle. This tends to draw the coating fluid out of the fluid passageway 156 through the aperture 104, where it encounters the moving air and is projected from the fluid outlet 100 as a fine spray of droplets (i.e. atomized). It should be noted that the coating fluid may be additionally (or primarily) urged through the fluid outlet by pressurization of the coating fluid and/or gravity acting upon the fluid in the fluid container, such that the primary function of the moving air is to atomize, rather than to draw the coating fluid through the fluid outlet.

FIG. 10 shows the nozzle assembly 10 with the adjustment member 150 rotated counterclockwise approximately 45 degrees to reach a non-atomizing position. In this configuration, the nozzle assembly 10 operates in its "bead" mode, where the adjustment member 150 and base member 152 are misaligned such that both the rear pressure apertures 154 and front pressure apertures 172 are substantially or fully occluded. As shown, the adjustment member 150 acts as a shutter that forms an air tight seal against the rear pressure apertures 154, while the front wall 166 likewise forms an air tight seal with respect to the front pressure apertures 172. Consequently, the atomizing inlet 110 is not in communication with the atomizing aperture 108 and the coating fluid extrudes, rather than sprays, from the fluid outlet 100. When operating in the "bead" mode, the coating fluid is urged through the fluid outlet by pressurization of the coating fluid and/or gravity acting upon the fluid in the fluid container.

If desired, the fluid outlet 100 can be adjusted to assume different cross-sections or profiles, thereby forming beads of different geometries. For example, a flattened bead could be dispensed from the spray gun 50 by extruding the fluid through an elongated rectangular fluid outlet. The ultimate size of the bead is controlled by the air pressure within the fluid container and the rate at which the fluid outlet 100 is moved along the substrate. For a large bead, the pressure can be increased and the tip moved slowly. For smaller beads, the pressure can be reduced and the tip moved quickly. Optionally, additional attachments may be implemented to help provide a more controllable bead size and reduced technique sensitivity.

In preferred embodiments, each of the components of the nozzle assembly 10—particularly base member 152, adjustment member 150, and pressure cap 114—are substantially made from disposable materials (e.g. plastics) and are intended to be disposed of after a single use. In some embodiments that use plastics, the plastic is solvent resistant. Each of the base member 152, adjustment member 150, and pressure cap 114 can be manufactured using any known method for manufacturing plastic components, such as injection molding. In preferred embodiments, the spray gun platform 130 is durable and reusable, and may be substantially made from metal. The illustrated embodiment is advantageous because the coating fluid only normally contacts the distal end 112' of the fluid needle 112 of the spray gun platform 130. As a result, only minimal cleaning is required between dispensing operations. As previously mentioned, even this cleaning step may be avoided by using a disposable fluid needle 112 incorporated into the nozzle assembly 10.

Figure 11:
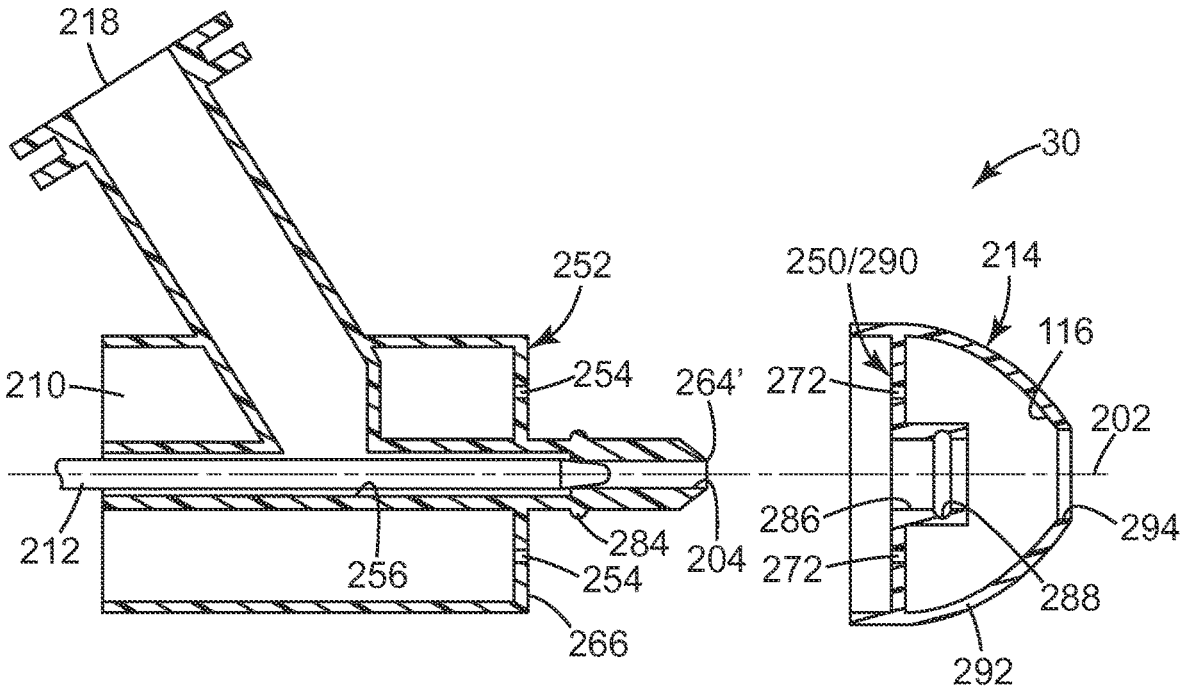
FIG. 11 is a fragmentary exploded side cross-sectional view of a nozzle assembly according to another exemplary embodiment, coupled to a spray gun platform.
Figure 12:
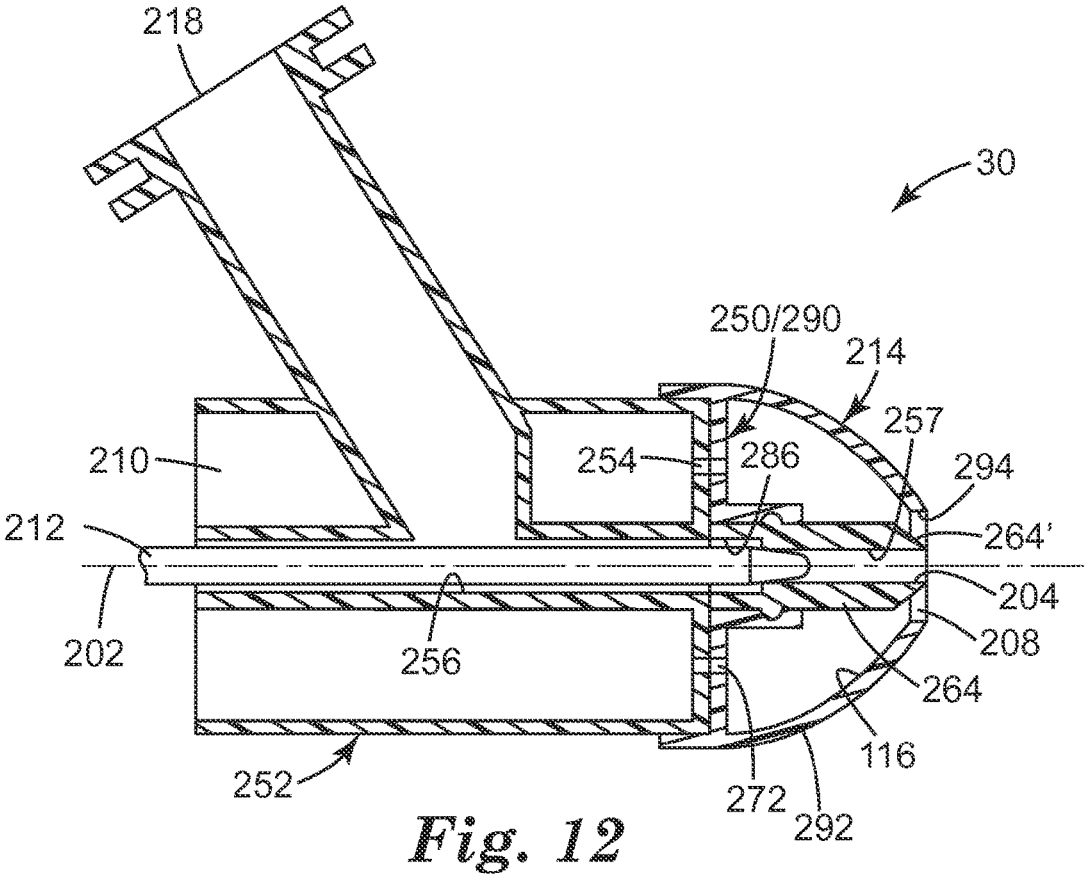
FIG. 12 is a fragmentary side cross-sectional view of the nozzle assembly of FIG. 11 as assembled, coupled to a spray gun platform.

FIGS. 11 and 12 show cross-sectional views of a nozzle assembly 30 according to an alternative embodiment bearing certain similarities to that of FIGS. 1-10. FIG. 11 shows the disassembled nozzle assembly 30, including a base member 252 and pressure cap 214. Like in the nozzle assembly 10, the base member 252 has an atomizing inlet 210 adapted for releasable engagement to a port on the spray gun platform 130 that provides pressurized air. Moreover, the pressure cap 214 is operatively coupled to the base member 252 to allow its rotation relative to the base member 252.

As described earlier, rotational stops may be used to limit rotational freedom of the pressure cap 214. As a further option, these components may include markings on their exterior surfaces along their interface apprising the operator of the dispensing mode associated with a given position of the pressure cap 214.

The nozzle assembly 30 is distinguished in one aspect from prior embodiments in that adjustment member 250 is incorporated into the pressure cap 214. As shown, the pressure cap 214 includes: (i) a back wall 290 having a plurality of front pressure apertures 272 (representing the adjustment member 250), and (ii) a side wall 292 having a generally parabolic shape and extending over the front surface of the back wall 290. As shown, the side wall 292 includes a centrally located distal opening 294.

The adjustment member 250 and pressure cap 214 rotate about fluid axis 202 relative to the base member 252. This rotation is guided by mating structures located on the adjustment member 250 and base member 252. As shown in the exemplary embodiment of FIG. 11, the base member 252 includes a front wall 266 and a fluid passageway 256 defined by a fluid side wall 264 that protrudes in the forward direction past the front wall 266. Located on the outer surfaces of the fluid side wall 264 is an annular ridge 284. Turning now to the pressure cap 214, the adjustment member 250 has a central aperture 286 adapted to receive the fluid side wall 264 in encircling relation. Located along the inner circumference of the central aperture 286 is a receiving groove 288 complementary to the annular ridge 284.

The locations of the receiving groove 288 and the annular ridge 284 may also be reversed such that the annular ridge 284 is located on the adjustment member 250 and the receiving groove 288 is located on the base member 252. These features may also be replaced or supplemented by one or more alternative retaining features suitable to permit the adjustment member to be retained with the base member while permitting relative motion between the parts.

FIG. 12 shows the base member 252 and pressure cap 214 as assembled. In this configuration, the fluid side wall 264 extends through the central aperture 286. With the pressure cap 214 fully seated as shown, the front wall 266 and the adjustment member 250 intimately contact each other to prevent air leakage along their contacting surfaces. The annular ridge 284 resides in the receiving groove 288 in snap fit relation, preventing sliding of the adjustment member 250/pressure cap 214 relative to the base member 252 along the fluid axis 202. With the distal end 264' of the fluid side wall 264 aligned with the distal opening 294 as shown, the atomizing aperture 208 is formed between a distal end 264' of the fluid side wall 264 and the pressure cap side wall 292.

Air flow though the nozzle assembly 30 is governed by interaction between rear pressure apertures 254 on the front wall 266 of the base member 252 and the front pressure apertures 272 on the back wall 290/adjustment member 250 of the pressure cap 214. As depicted in FIG. 12, the rear and front pressure apertures 254, 272 are aligned with each other, thus allowing air to pass freely from the atomizing inlet 210 to the atomizing aperture 208.

FIGS. 11-12 show a fluid needle 212 from a compatible spray gun platform received in the fluid passageway 256. In this configuration, the fluid needle 212 forms a fluid-tight seal against a narrowed section 257 of the fluid passageway 256, preventing flow of the coating fluid to the fluid aperture 204. This position of the fluid needle 212 corresponds to a neutral position for the trigger 22 in which coating fluid does not dispense from the spray gun 50. In some embodiments, the spray gun platform 130 includes a built in valve that allows pressurized air to enter the atomizing inlet 210 if and only if the trigger 22 of the spray gun platform 130 is depressed.

Further options and advantages of the nozzle assembly 30 are analogous to those already described with respect to nozzle assembly 10 and will not be repeated.

Figure 13:
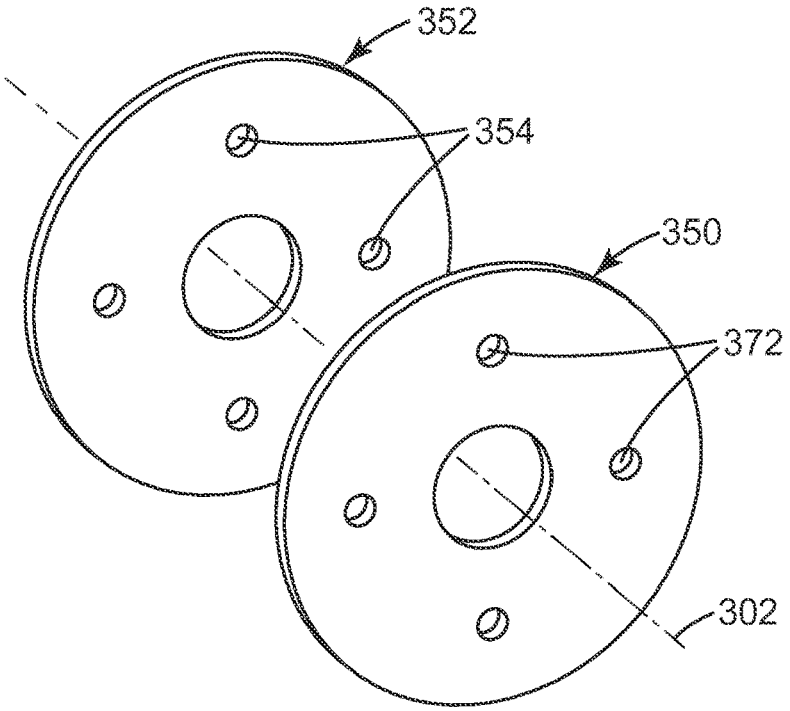
FIG. 13 is a fragmentary perspective view of adjacent nozzle assembly components according to still another exemplary embodiment, showing front, top, and right side surfaces.
Figure 14:
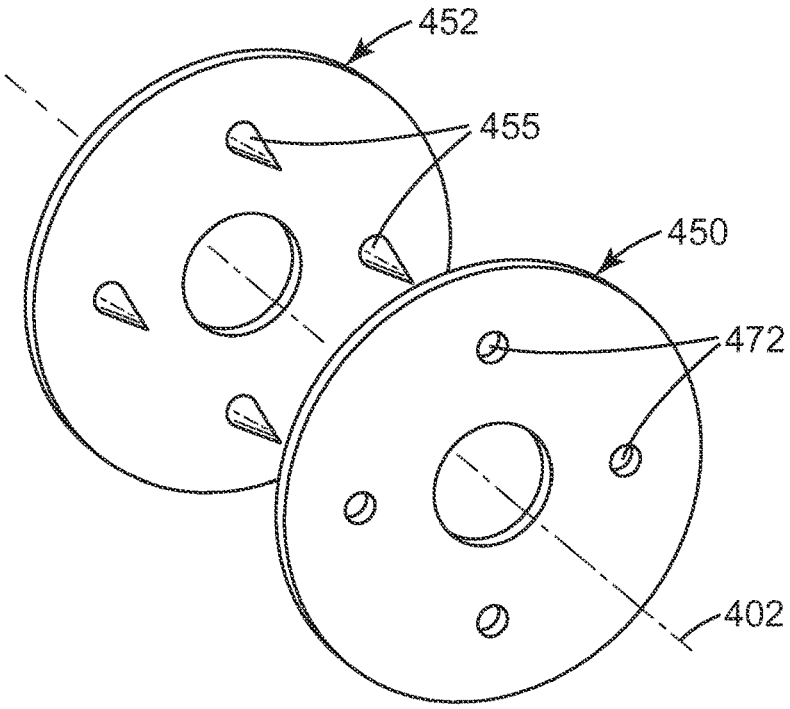
FIG. 14 is a fragmentary perspective view of adjacent nozzle assembly components according to yet another exemplary embodiment, showing front, top, and right side surfaces.

FIGS. 13 and 14 are exploded views showing alternative geometries for base member 352, 452 and adjustment member 350, 450 providing alternative ways for a nozzle assembly to shift between atomizing and non-atomizing modes. Surrounding components of the nozzle assembly are omitted for clarity.

FIG. 13 shows a configuration in which both the base member 352 and opposing adjustment member 350 include plurality of pressure apertures 354, 372 that are circular. The pressure apertures 354, 372 are symmetrically disposed about a fluid axis 302. Air flows through the nozzle assembly when the rear pressure apertures 354 and front pressure apertures 372 are aligned (as shown), while air flow is impeded when the pressure apertures 354, 372 are out of alignment. It is worth noting that the pressure apertures 354 could also be arranged in a non-symmetrical fashion, so long as the ability to block and unblock the apertures is preserved.

FIG. 14 shows a variant in which the base member 452 includes a plurality of protrusions 455 (in this case, conical in profile), each opposing a respective pressure aperture 472. Here, the base member 452 and adjustment member 450 do not rotate relative to each other. Rather, air flow through the nozzle assembly is controlled by translating the base member 452 and/or adjustment member 450 relative to each other. For example, as the base member 452 and adjustment member 450 are urged toward each other along fluid axis 402, the protrusions 455 are received into respective pressure apertures 472. This blocks air flow through the pressure apertures 472, thereby placing the adjustment member 450 in a non-atomizing position where the coating fluid beads from the nozzle assembly.

Using a translation motion to seal the pressure apertures 472 can be advantageous because the conical protrusions 455 are oversized to create an interference fit against the inner walls of the pressure apertures 472. This, in turn, results in a robust seal and reduced likelihood of undesirable air leakage.

Moreover, pressure apertures 472 and protrusions 455 may be adapted to cooperate to provide proportional air flow control. For example, when a conical protrusion is positioned partially within a cooperative pressure aperture, an annular cross-sectional air flow area is created. As the conical protrusion translates further into the pressure aperture, the annular cross-sectional air flow area is reduced, thereby providing increased flow restriction (and thereby reduced air flow). Conversely, as the conical protrusion translates out of the pressure aperture, the annular cross-sectional air flow area is increased, thereby providing reduced flow restriction (and thereby increased air flow).

As described herein, the term "conical" refers to a category of geometric profiles having a cross-sectional area that reduces along a major axis of the profile from an attached end to a distal end, wherein the cross-sectional area need not be circular, and the reduction of the cross-sectional area need not be linear or continuous. Other geometries for the protrusions 555 may include, for example, hemispheres, pyramids, and rectangular prisms. FIGS. 18A, 18A', 18B, 18B', 18C, 18C', 18D, and 18D' compare the protrusion 455 with alternative protrusions having various shapes, each protrusion being capable of providing an air-tight seal against the pressure aperture 472.

Figure 15:
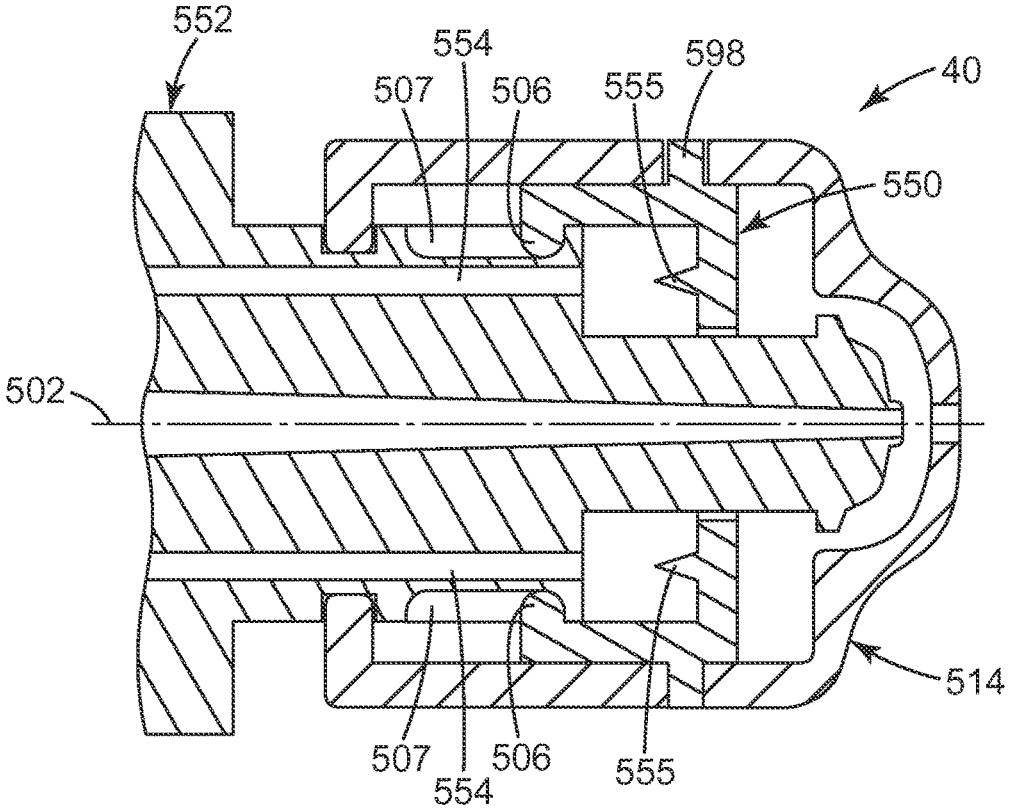
FIG. 15 is a fragmentary cross-sectional view of a nozzle assembly according to yet another exemplary embodiment.
Figure 16:
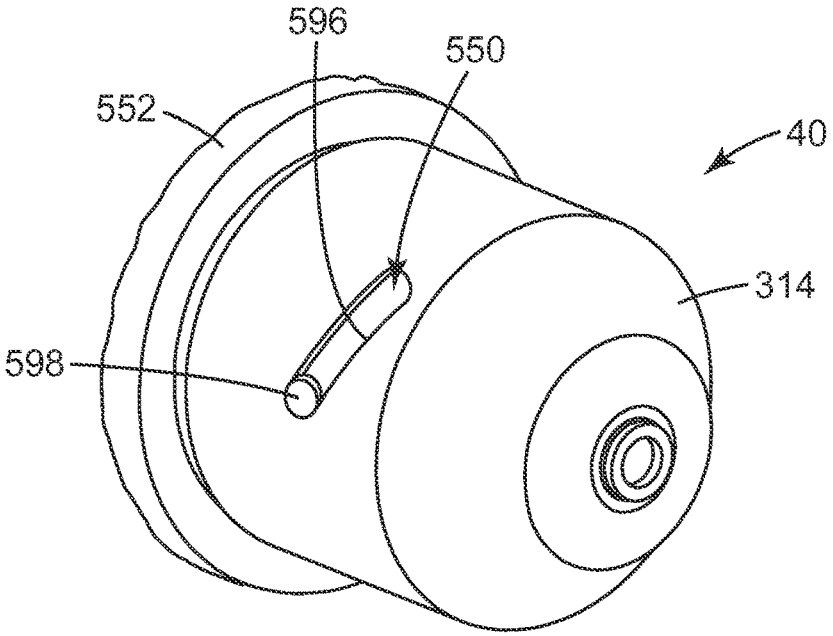
FIG. 16 is a perspective view of the nozzle assembly of FIG. 15, showing its front and right side surfaces.

FIGS. 15 and 16 show a nozzle assembly 40 implementing conical protrusions 555 to control air flow. In FIG. 15, the nozzle assembly 40 shares many aspects of nozzle assembly 10, such as having a base member 552 and pressure cap 514 secured to each other and an adjustment member 550 held captive between the base member 552 and pressure cap 514. Instead of apertures, the adjustment member 550 has a plurality of the conical protrusions 555 receivable into complementary pressure apertures 554 extending through the base member 552.

As the adjustment member 550 translates along fluid axis 502 toward or away from the base member 552, neither component rotates about the fluid axis 502. The base member 552 is fixed relative to the spray gun platform, while the adjustment member 550 has inwardly protruding tabs 506 that are received in longitudinal indentations 507 extending parallel the fluid axis 502 along the exterior surface of the base member 552. The tabs 506 are constrained to travel along the indentations 507, preventing rotation of the adjustment member 550.

Translation of the adjustment member 550 is achieved by rotating the pressure cap 514 relative to the base member 552. As shown in FIG. 16, the pressure cap 514 has one or more camming tracks 596, each acutely angled with respect to the fluid axis 502. The camming tracks 596 receive one or more respective buttons 598 that protrude outwardly from the adjustment member 550. As the pressure cap 514 rotates, the buttons 598 contact the sides of the camming tracks 596, causing the adjustment member 550 to slide either forwards or backwards relative to the base member 552 (depending on the direction of rotation). The orientation of the camming tracks 596 can be tailored to the rotational range of the pressure cap 514 and desired air flow characteristics.

The locations of the camming track(s) 596 and the button(s) 598 may also be reversed such that a camming track 596 is located on the adjustment member 550 and a button 598 is located on the pressure cap 514. These features may also be replaced or supplemented by one or more alternative features suitable to permit the pressure cap to rotate with respect to the base member 552 while permitting the adjustment member 550 to translate with respect to the base member 552.

Figure 17:
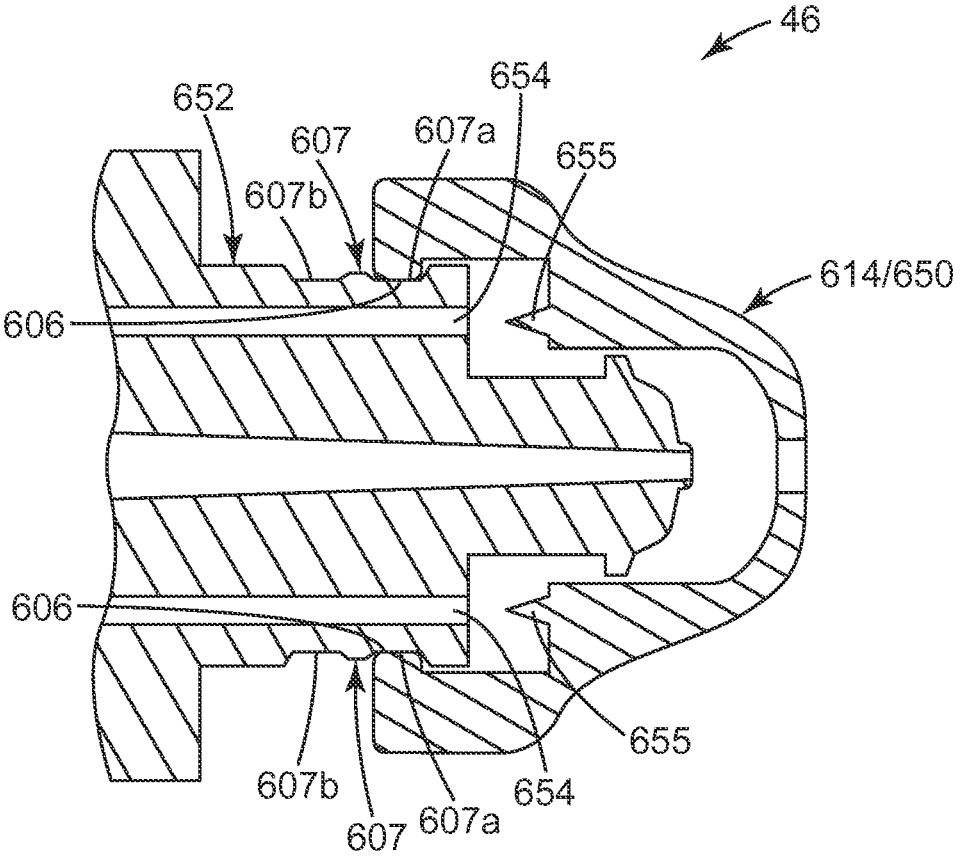
FIG. 17 is a fragmentary cross-sectional view of a nozzle assembly according to yet another exemplary embodiment.

FIG. 17 shows a nozzle assembly 46 providing yet another mechanism for shifting between atomizing and non-atomizing dispensing modes. The nozzle assembly 46 has a base member 652 and adjustment member 650 integral with pressure cap 614. Located on the base member 652 and adjustment member 650 are pressure apertures 654 and conical protrusions 655, respectively. Inwardly protruding tabs 606 on the adjustment member 650 reside in matching indentation 607 on the base member 652, slidably coupling these components to each other.

Translating the adjustment member 650 toward the base member 652 causes the protrusions 655 (when fully translated) to form a fluid-tight seal against pressure apertures 654. To accomplish this, the operator uses finger pressure to urge these components toward each other and shift the tabs 606 from a first equilibrium position 607*a* corresponding to an atomizing position to a second equilibrium position 607*b* corresponding to a non-atomizing position. From there, the reverse action can be used to return the nozzle assembly 46 to its atomizing mode. As described above, such features can be also be used to provide proportional air flow control, in addition to on/off functionality.

Other aspects of nozzle assemblies 40, 46 are similar to those already described with respect to nozzle assemblies 10, 30.

Although not illustrated here, the adjustment member can optionally move between the atomizing position and the non-atomizing position by both rotating about and translating along the fluid axis. For example, the base member and adjustment member could be operatively coupled to each other by a screw-type mechanism, where protrusions on one member are suitably angled to seal against apertures on the opposing member.

It should be understood that, for the purposes of aligning pressure apertures on the base member and/or adjustment member, relative movement need not occur along or about the fluid axis of the nozzle assembly. For example, the adjustment member could slide along a track in a direction perpendicular to the fluid axis, or some other direction, and still effectively function as a shutter to toggle air flow through the atomizing aperture. Likewise, the adjustment member could rotate relative to the base member about a direction not aligned with the fluid axis, yet still serve the foregoing function.

FIG. 18 shows a nozzle assembly 48 according to yet another exemplary embodiment. The nozzle assembly 48 includes a base member 752, adjustment member 750, and pressure cap 714 arranged similarly in many respects to those of nozzle assembly 10. The pressure cap 714, however, further includes a pair of air horns 732 extending outwardly from its side wall 716. Each air horn includes a pair of air horn apertures 734 having a configuration to direct air flow against opposing sides of a conical fluid spray pattern discharged from the fluid outlet 100. Instead of a fan control stopper, the pressure cap 714 has a fan control aperture 740 that communicates with the air horn apertures 734.

In the configuration of FIG. 18, which shows the nozzle assembly 48 in its spray mode, the fan control aperture 740 is aligned with a fan control inlet 736 of the base member 752 that extends from its gun interface portion 720 to its front wall 766. The air horn apertures 734 are thus in communication with the spray gun platform 130 when the adjustment member 750 is in its atomizing position. In a preferred embodiment, pressurized air from the fan control regulator 26 is routed through ports on the spray gun platform 130 to the air horn apertures 734.

Next to the fan control aperture 740 is a fan control sidewall 738 adjacent to the fan control inlet 736 and positioned along a rotational path of travel relative to the base member 752. The fan control sidewall 738 surrounds the fan control aperture 740, defining a movable orifice that permits air flow to the air horns 732 when the air horn functionality is needed and blocks air flow to the air horns 732 when such functionality is not needed. The fan control sidewall 738 is registered with the spray gun platform 130 such that the horn apertures 734 do not communicate with the fan control inlet 736 when the adjustment member 150 is rotated to its non-atomizing position. Further details concerning operation of the air horns 732 are described in PCT Application No. WO 2010/085801 (Escoto, et al.).

Spray gun systems, kits, and other packaged assemblies that include the foregoing nozzle assemblies are also contemplated. For example, a spray gun system could include a spray gun platform and a set of nozzle assemblies adapted for modular connection to the spray gun platform. If the nozzle assemblies are disposable, they can be provided in replicated sets for high volume applications. Optionally, the system could include an assortment of different nozzle assemblies, some being adapted for dual-mode use and some adapted only for single-mode use. Sets of nozzle assemblies could further include nozzle assemblies having a variety of fluid outlet diameters appropriate for different applications and/or different coating fluids.

Moreover, the foregoing nozzle assemblies could be provided as part of a kit that includes one or more other modular components including, but not limited to, caps, connectors, adaptors, and fluid containers for use with the nozzle assemblies. Kits may also include one or more coating fluids dispensable through the nozzle assemblies. Various combinations of the above components may also be integrated and packaged accordingly.

Various aspects of the invention are exemplified by one or more of the following embodiments:

A. A nozzle assembly including: a fluid outlet extending along a fluid axis and including a fluid aperture and fluid side wall defining the fluid aperture; an atomizing aperture adjacent the fluid side wall and at least partially surrounding the fluid axis; an atomizing inlet configured to receive a pressurized gas; and an adjustment member located on the nozzle assembly and movable to: (i) an atomizing position such that the atomizing inlet is in communication with the atomizing aperture; and (ii) a non-atomizing position such that the atomizing inlet is not in communication with the atomizing aperture.

B. The nozzle assembly of embodiment A, further including a fluid needle including a distal end, the fluid needle being movable along the fluid axis to: (i) a closed position such that distal end fully occludes the fluid aperture; and (ii) an open position such that distal end does not fully occlude the fluid aperture.

C. The nozzle assembly of embodiment A or B, further including a gun interface portion adapted to releasably attach the nozzle assembly to a spray gun platform.

D. The nozzle assembly of any one of embodiments A-C, where the adjustment member is movable to the atomizing position and the non-atomizing position by rotation of the adjustment member about the fluid axis.

E. The nozzle assembly of any one of embodiments A-D, further including a pressure cap adjacent the adjustment member and having a pressure cap side wall, where the atomizing aperture is formed between the pressure cap side wall and the fluid side wall.

F. The nozzle assembly of embodiment E, where the adjustment member is movable relative to the pressure cap.

G. The nozzle assembly of embodiment E, where the adjustment member is movable together with the pressure cap.

H. The nozzle assembly of embodiment G, where the adjustment member is integral with the pressure cap.

I. The nozzle assembly of embodiment E, where the nozzle assembly further includes a fan control inlet and the pressure cap further including a pair of horns projecting outwardly from the pressure cap side wall, the pair of horns having respective air horn apertures in communication with the fan control inlet when the adjustment member is in its atomizing position, whereby air flowing through the atomizing inlet flows against opposing sides of a stream of fluid being discharged from the nozzle assembly.

J. The nozzle assembly of embodiment I, where the adjustment member includes a fan control shutter that prevents communication between the horn apertures and the fan control inlet when the adjustment member is in its non-atomizing position.

K. The nozzle assembly of any one of embodiments A-J, where the adjustment member is movably coupled to an opposing base member, where at least one of the adjustment member and the base member includes a pressure aperture permitting selective communication between the atomizing inlet and the atomizing aperture, and further where: (i) in the non-atomizing position, the pressure aperture is substantially occluded; and (ii) in the atomizing position, the pressure aperture is not substantially occluded.

L. The nozzle assembly of embodiment K, where the pressure aperture includes a front pressure aperture located on the adjustment member and a rear pressure aperture located on the base member, and further where: (i) in the non-atomizing position, the front pressure aperture is misaligned with the rear pressure aperture whereby both the front and rear pressure apertures are fully occluded; and (ii) in the atomizing position, the front pressure aperture is at least partially aligned with the rear pressure aperture whereby neither the front pressure aperture nor the rear pressure aperture is fully occluded.

M. The nozzle assembly of embodiment L, where rotation of the adjustment member relative to the base member causes the alignment and misalignment of the front and rear pressure apertures.

N. The nozzle assembly of embodiment M, where the adjustment member rotates relative to the base member about the fluid axis.

O. The nozzle assembly of any one of embodiments L-N, where at least one of the front and rear pressure apertures is generally circular as viewed along the fluid axis.

P. The nozzle assembly of any one of embodiments L-N, where at least one of the front and rear pressure apertures includes an elongated slot as viewed from a direction parallel the fluid axis.

Q. The nozzle assembly of embodiment P, where the slot is tapered such that its radial width varies along its length.

R. The nozzle assembly of any one of embodiments K-Q, where at least one of the adjustment member and the base member includes a plurality of pressure apertures disposed along a circular path concentric with the fluid axis.

S. The nozzle assembly of any one of embodiments K-R, where the adjustment member is movable between the atomizing position and the non-atomizing position by translation along the fluid axis.

T. The nozzle assembly of embodiment S, where either the base member or adjustment member includes a protrusion receivable into a corresponding pressure aperture located on the opposing base member or adjustment member as the adjustment member moves toward the non-atomizing position.

U. The nozzle assembly of embodiment T, where the protrusion has a generally conical configuration adapted to form an interference fit with the pressure apertures.

V. The nozzle assembly of embodiment T or U, where neither the base member nor adjustment member rotate relative to each other as the adjustment member translates along the fluid axis.

W. The nozzle assembly of embodiment V, where the adjustment member is operatively coupled to the pressure cap whereby the adjustment member translates as the pressure cap rotates.

X. The nozzle assembly of embodiment K, where the adjustment member is movable between the atomizing position and the non-atomizing position by rotation about the fluid axis and translation along the fluid axis.

Y. The nozzle assembly of any one of embodiments A-X, where the adjustment member is movable to an intermediate position such the atomizing inlet is in communication with the atomizing aperture, but with flow restriction between the atomizing inlet and the atomizing aperture relative to when the adjustment member is in the atomizing position.

Z. The nozzle assembly of embodiment Y, where the degree of flow restriction increases approximately linearly as the adjustment member is moved from the atomizing position toward the non-atomizing position.

AA. The nozzle assembly of any one of embodiments A-Z, further including a fluid inlet adapted for releasable connection to a fluid container.

AB. The nozzle assembly of embodiment AA, further including a gun interface portion adapted to releasably attach the nozzle assembly to a spray gun platform, where the fluid inlet is formed within the gun interface portion such that a fluid delivered to the nozzle assembly passes through the spray gun platform.

AC. The nozzle assembly of embodiment AA, further including a gun interface portion adapted to releasably attach the nozzle assembly to a spray gun platform, where the fluid inlet is formed outboard from the gun interface portion such that a fluid delivered to the nozzle assembly does not pass through the spray gun platform.

AD. A spray gun assembly including the nozzle assembly of any one of embodiments A-AC and a spray gun platform releasably connected to the nozzle assembly.

AE. A method of adjusting a dispensing mode for a spray gun, the spray gun including a spray gun platform and a nozzle assembly connected to the spray gun platform, the nozzle assembly including a fluid aperture extending along a fluid axis for receiving and dispensing a fluid and a fluid side wall defining the fluid aperture, the method including the steps of: providing an atomizing aperture adjacent the fluid side wall, where the atomizing aperture at least partially surrounds the fluid axis; and moving an adjustment member located on the nozzle assembly between: (i) an atomizing position where the atomizing aperture communicates with a pressurized gas whereby the fluid sprays from the fluid aperture; and (ii) a non-atomizing position where the atomizing aperture does not communicate with a pressurized gas whereby the fluid extrudes from the fluid aperture.

AF. The method of embodiment AE, where the nozzle assembly and spray gun platform releasably connect to each other.

AG. The method of embodiment AE or AF, where the adjustment member is movably coupled to a base member on the nozzle assembly and where at least one of the adjustment member and the base member includes a pressure aperture for providing selective communication between the atomizing aperture and the pressurized gas.

AH. The method of any one of embodiments AE-AG, where moving the adjustment member includes rotating the adjustment member relative to the base member between the non-atomizing and atomizing positions.

AI. The method of any one of embodiments AE-AG, where moving the adjustment member includes translating the adjustment member relative to the base member between the non-atomizing and atomizing positions.

AJ. The method of embodiment AI, where the nozzle assembly further includes a pressure cap rotatably connected to the base member and having a pressure cap side wall, the atomizing aperture being formed between the pressure cap side wall and the fluid side wall, and where translating the adjustment member relative to the base member includes rotating the pressure cap relative to the base member.

AK. The method of any one of embodiments AE-AJ, where the nozzle assembly includes a fluid inlet adapted for releasable connection to a fluid container.

AL. The method of embodiment AK, where the nozzle assembly further includes a gun interface portion for releasably attaching the nozzle assembly to a spray gun platform and where the fluid inlet is formed within the gun interface portion such that a fluid delivered to the nozzle assembly passes through the spray gun platform.

AM. The method of embodiment AK, where the nozzle assembly further includes a gun interface portion adapted to releasably attach the nozzle assembly to a spray gun platform and where the fluid inlet is formed outboard from the gun interface portion such that a fluid delivered to the nozzle assembly does not pass through the spray gun platform to prevent contaminating the spray gun platform during a dispensing operation.

AN. A spray gun system including: a spray gun platform; and a set of nozzle assemblies adapted for modular connection to the spray gun platform, where at least one but fewer than all nozzle assemblies in the set include: a fluid outlet extending along a fluid axis and including a fluid aperture and fluid side wall defining the fluid aperture; an atomizing aperture adjacent the fluid side wall and at least partially surrounding the fluid axis; an atomizing inlet configured to receive a pressurized gas; and an adjustment member located on the nozzle assembly and movable to: (i) an atomizing position such that the atomizing inlet is in communication with the atomizing aperture; and (ii) a non-atomizing position such that the atomizing inlet is not in communication with the atomizing aperture.

All patents and patent applications mentioned above are hereby expressly incorporated by reference. Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. A nozzle assembly comprising:

a fluid outlet extending along a fluid axis and comprising a fluid aperture and a fluid side wall defining the fluid aperture;

an atomizing aperture adjacent the fluid side wall and at least partially surrounding the fluid axis;

an atomizing inlet configured to receive a pressurized gas; and an annular adjustment member, located on the nozzle assembly, comprising the fluid aperture and movable to:

(i) an atomizing position such that the atomizing inlet is in communication with the atomizing aperture; and (ii) a non-atomizing position such that the atomizing inlet is not in communication with the atomizing aperture, wherein when the annular adjustment member is in the atomizing position, fluid dispenses in a spray pattern, and when the annular adjustment member is in the non-atomizing position, fluid dispenses in a bead pattern; and a pressure cap adjacent the annular adjustment member and having a pressure cap side wall, the pressure cap further comprising:

a pair of horns projecting outwardly from the pressure cap side wall, the pair of horns having respective horn apertures in communication with the atomizing inlet when the annular adjustment member is in the atomizing position, whereby air flowing through the atomizing inlet flows against opposing sides of a stream of fluid being discharged from the nozzle assembly;

wherein the atomizing aperture is formed between the pressure cap side wall and the fluid side wall;

wherein the annular adjustment member comprises a fan control shutter that prevents communication between the horn apertures and the atomizing inlet when the annular adjustment member rotates to the non-atomizing position.

2. The nozzle assembly of claim 1, wherein the annular adjustment member is movable to the atomizing position and the non-atomizing position by rotation of the annular adjustment member about the fluid axis.

3. The nozzle assembly of claim 1, wherein the annular adjustment member is movable relative to the pressure cap.

4. The nozzle assembly of claim 1, wherein the annular adjustment member is movable together with the pressure cap.

5. The nozzle assembly of claim 1, wherein the annular adjustment member is movably coupled to an opposing base member, wherein at least one of the annular adjustment member and the base member comprises a pressure aperture permitting selective communication between the atomizing inlet and the atomizing aperture, and further wherein:

(i) in the non-atomizing position, the pressure aperture is occluded; and (ii) in the atomizing position, the pressure aperture is not occluded.

6. The nozzle assembly of claim 5, wherein the pressure aperture comprises a front pressure aperture located on the annular adjustment member and a rear pressure aperture located on the base member, and further wherein:

(i) in the non-atomizing position, the front pressure aperture is misaligned with the rear pressure aperture whereby both the front and rear pressure apertures are fully occluded; and (ii) in the atomizing position, the front pressure aperture is at least partially aligned with the rear pressure aperture whereby neither the front pressure aperture nor the rear pressure aperture is fully occluded.

7. The nozzle assembly of claim 6, wherein rotation of the annular adjustment member relative to the base member causes the alignment and misalignment of the front and rear pressure apertures.

8. The nozzle assembly of claim 5, wherein the annular adjustment member is movable between the atomizing position and the non-atomizing position by translation along the fluid axis.

9. The nozzle assembly of claim 8, wherein either the base member or annular adjustment member comprises a protrusion receivable into a corresponding pressure aperture located on the opposing base member or annular adjustment member as the annular adjustment member moves toward the non-atomizing position.

10. The nozzle assembly of claim 9, wherein neither the base member nor annular adjustment member rotate relative to each other as the annular adjustment member translates along the fluid axis.

11. The nozzle assembly of claim 1, wherein the annular adjustment member is movable to an intermediate position such the atomizing inlet is in communication with the atomizing aperture, but with flow restriction between the atomizing inlet and the atomizing aperture relative to when the annular adjustment member is in the atomizing position.

12. The nozzle assembly of claim 1, further comprising:

a gun interface portion adapted to releasably attach the nozzle assembly to a spray gun platform; and a fluid inlet formed outboard from the gun interface portion such that a fluid delivered to the nozzle assembly does not pass through the spray gun platform.

13. A method of adjusting a dispensing mode for a spray gun, the spray gun comprising a spray gun platform and a nozzle assembly connected to the spray gun platform, the nozzle assembly including a fluid aperture extending along a fluid axis for receiving and dispensing a fluid and a fluid side wall defining the fluid aperture, the method comprising the steps of:

providing an atomizing aperture adjacent the fluid side wall, wherein the atomizing aperture at least partially surrounds the fluid axis; and providing an annular adjustment member, located on the nozzle assembly, comprising the fluid aperture and moving the annular adjustment member between:

(i) an atomizing position where the atomizing aperture communicates with a pressurized gas whereby the fluid sprays from the fluid aperture;

(ii) a non-atomizing position where the atomizing aperture does not communicate with the pressurized gas whereby the fluid extrudes from the fluid aperture; and providing a pressure cap adjacent the annular adjustment member and having a pressure cap side wall, the pressure cap further comprising:

a pair of horns projecting outwardly from the pressure cap side wall, the pair of horns having respective horn apertures in communication with the atomizing inlet when the annular adjustment member is in the atomizing position, whereby air flowing through the atomizing inlet flows against opposing sides of a stream of fluid being discharged from the nozzle assembly, wherein the atomizing aperture is formed between the pressure cap side wall and the fluid side wall;

wherein the annular adjustment member comprises a fan control shutter that prevents communication between the horn apertures and the atomizing inlet when the annular adjustment member rotates to the non-atomizing position.

14. The method of claim 13, wherein the annular adjustment member is movably coupled to a base member on the nozzle assembly and wherein at least one of the annular adjustment member and the base member comprises a pressure aperture for providing selective communication between the atomizing aperture and the pressurized gas.

15. The method of claim 13, wherein moving the annular adjustment member comprises rotating the annular adjustment member relative to a base member between the non-atomizing and atomizing positions.

16. The method of claim 13, wherein moving the annular adjustment member comprises translating the annular adjustment member relative to a base member between the non-atomizing and atomizing positions.

17. A spray gun system comprising:

a spray gun platform; and the nozzle assembly of claim 1.

* * * * *